US011098978B2

(12) United States Patent
Rassias

(10) Patent No.: US 11,098,978 B2
(45) Date of Patent: Aug. 24, 2021

(54) SAFETY HOLSTER

(71) Applicant: John N. Rassias, Boca Raton, FL (US)

(72) Inventor: John N. Rassias, Boca Raton, FL (US)

( * ) Notice: Subject to any disclaimer, the term of this patent is extended or adjusted under 35 U.S.C. 154(b) by 29 days.

(21) Appl. No.: 16/572,100

(22) Filed: Sep. 16, 2019

(65) Prior Publication Data

US 2020/0141693 A1 May 7, 2020

Related U.S. Application Data

(60) Provisional application No. 62/771,935, filed on Nov. 27, 2018, provisional application No. 62/731,388, filed on Sep. 14, 2018.

(51) Int. Cl.
*F41C 33/02* (2006.01)
*F41C 33/04* (2006.01)

(52) U.S. Cl.
CPC ..... *F41C 33/0236* (2013.01); *F41C 33/0245* (2013.01); *F41C 33/0263* (2013.01); *F41C 33/041* (2013.01)

(58) Field of Classification Search
CPC ..... F41C 33/0236; F41C 33/0245; F41C 33/0263; F41C 33/041
See application file for complete search history.

(56) References Cited

U.S. PATENT DOCUMENTS 4,055,015 A * 10/1977 Musgrave ..... F41C 33/04 42/106
5,611,164 A * 3/1997 Rassias ..... F41A 17/44 42/70.11
6,267,279 B1 * 7/2001 Matthews ..... F41C 33/0236 224/191
6,415,541 B1 * 7/2002 Rassias ..... F41C 33/0227 42/70.11
6,585,209 B1 * 7/2003 Mattingly ..... F41C 33/0245 248/121
6,755,331 B2 6/2004 Rassias
7,543,404 B2 * 6/2009 Kovalchuk ..... F41C 33/0263 42/106
8,215,525 B2 7/2012 Rassias
10,436,550 B2 * 10/2019 Lance ..... F41C 33/0245
2003/0205594 A1 * 11/2003 Rassias ..... F41C 33/0245 224/192
2005/0224537 A1 * 10/2005 Rassias ..... F41C 33/0218 224/243
2007/0108242 A1 * 5/2007 Rassias ..... F41C 33/0263 224/243
2007/0163164 A1 * 7/2007 Avrahami ..... F41C 33/0227 42/87
2008/0093400 A1 * 4/2008 Stevens ..... F41C 33/0281 224/243

(Continued)

FOREIGN PATENT DOCUMENTS

WO 2017124072 A1 7/2017

*Primary Examiner* — Corey N Skurdal
(74) *Attorney, Agent, or Firm* — The Webb Law Firm

(57) ABSTRACT

A holster includes a hip plate and a shroud mounted to the hip plate. The shroud includes a channel adapted to receive a slide of a firearm, a slide block extending into an open portion of the channel and configured to abut a muzzle end of the slide received in the channel to prevent forward movement of the slide, and a locking lug extending into the open portion of the channel and configured to engage a chamber of the slide to prevent movement of the slide.

21 Claims, 17 Drawing Sheets

(56) References Cited

U.S. PATENT DOCUMENTS

| | | | | |
|---|---|---|---|---|
| 2009/0001117 | A1* | 1/2009 | Rassias | F41C 33/0281<br>224/673 |
| 2009/0114693 | A1* | 5/2009 | Rassias | F41C 33/0263<br>224/663 |

* cited by examiner

SAFETY HOLSTER

CROSS REFERENCE TO RELATED APPLICATIONS

The present application claims the benefit of U.S. Provisional Patent Application No. 62/731,388, filed on Sep. 14, 2018, and of U.S. Provisional Patent Application No. 62/771,935, filed on Nov. 27, 2018, the disclosures of both of which are hereby incorporated by reference in their entireties.

BACKGROUND OF THE INVENTION

Field of the Invention

The present invention relates to the field of holsters and, in particular, holsters that are detachable, lockable, and prevent accidental discharge of firearms. The present invention also relates to methods of holstering and unholstering a firearm.

Description of Related Art

Current designs of holsters provide a means of carrying a pistol so that it is available to be withdrawn as quickly as possible when needed and, subsequently, a means to re-holster the pistol when the resolved situation warrants. Within the current constructs of design, users generally have two ways to carry a pistol. A first option is to carry the pistol with a cartridge loaded within the firing chamber with the trigger actionable. A second option is to carry the pistol with no cartridge loaded within the firing chamber with the trigger still actionable. The first option has the advantage of quicker single handed draw and firing. However, a pistol with a round chambered presents the possibility of pressing the trigger during the draw with the pistol's muzzle still pointed at the user's foot, leg, or other unintended target, which may result in an accidental discharge and consequent injury or property damage. The second option, in which no cartridge is chambered, may be considered as a generally safer way to carry a pistol, as the pistol is not aimed at one's foot or leg upon drawing. However, the second option requires two hands to chamber a cartridge in the pistol subsequent to drawing the pistol, which may significantly increase the time required to draw the pistol and ready the pistol for firing.

Both the first and second options described above for carrying a pistol suffer from another disadvantage in that neither option provides a means for visually or tactically ascertaining whether the pistol in the holster has a round chambered or not. As such, if a user forgets whether the pistol was holstered with a round chambered, the user must first inspect the pistol upon drawing to ascertain whether the pistol is ready to be fired or whether a round must be chambered. Again, this verification process may substantially delay the user's ability to fire the pistol as rapidly as desired.

Holsters and the process of holstering/unholstering a pistol may be further complicated by sight accessories attached to the pistol, such as laser or holographic sights. These sight accessories project an image, generally a dot or target symbol, onto objects in the projectile path of the pistol to indicate the expected impact location of a round fired from the pistol. Sight accessories are used as an alternative or supplement to conventional front and rear sight projections on the pistol. Sight accessories may be used to address common deficiencies and difficulties in using conventional sights. One such difficulty is parallax, i.e., the effect whereby the position or direction of an object appears to differ when viewed from different positions, when viewing a target through conventional sights. Additionally, alignment of the front and rear sights of a pistol may be further compromised by focal confusion in attempting to align one point of reference within narrow confines, with one or the other blurred onto a third element.

One popular variety of sight accessory is a red dot sight. Typically, a red dot sight includes a projection device which attaches to the slide of a pistol and projects an optical beam toward an optic lens. The optic lens directs the beam along the firing trajectory of the pistol, thereby displaying a dot on any object crossing the firing path. The optic lens is susceptible to misalignment due to jostling during use and holstering of the pistol, rendering the red dot sight inaccurate when the need to fire the pistol arises. Additionally, the optic lens may become contaminated with dust, debris, or liquids which similarly cause inaccurate projection of the beam through the optic lens. Many manufacturers provide covers to prevent contamination of the optic lens when the pistol is holstered or otherwise not in use, but such covers are easily lost or misplaced and provide no protection against unintended misalignment.

In view of the foregoing deficiencies of current holster designs, there exists a need for a holster which both prevents accidental discharge while drawing the pistol and also permits one-handed drawing and firing of the pistol. Also, there exists a need for a holster which leaves the user with no doubt as to the presence or absence of a round in the chamber. Additionally, there exists a need for safer methods of holstering and unholstering a pistol. Still further, there exists a need for a holster which accommodates and protects sight accessory devices attached to a pistol.

SUMMARY OF THE INVENTION

Embodiments of the present invention are directed to a holster including a hip plate and a shroud mounted to the hip plate. The shroud includes a channel adapted to receive a slide of a firearm, a slide block extending into an open portion of the channel and configured to abut a muzzle end of the slide received in the channel to prevent forward movement of the slide, and a locking lug extending into the open portion of the channel and configured to engage a chamber of the slide to prevent movement of the slide.

In some embodiments, the shroud is configured to contact a lock lever of the firearm during insertion of the firearm into the shroud such that the lock lever disengages from the slide, thereby allowing the slide to move from a fully retracted position to a partially retracted position.

In some embodiments, the locking lug extends into the chamber such that a round in a magazine of the firearm received in the shroud is prevented from entering the chamber.

In some embodiments, the locking lug extends into the channel of the shroud such that, if the firearm has a round chambered, the locking lug contacts the round and prevents the firearm from being seated in the shroud.

In some embodiments, the shroud is removably mounted to the hip plate.

In some embodiments, the holster further includes a locking bar inserted into a locking pin aperture of the shroud, the locking bar abutting a muzzle of the firearm to prevent forward movement of the muzzle within the shroud.

In some embodiments, the locking bar is rectilinear and configured to engage a front face of the muzzle.

In some embodiments, the locking bar includes a locking device configured to prevent removal of the locking bar from the locking pin aperture.

In some embodiments, the locking device is pivotally connected to the locking bar via a bearing.

In some embodiments, the shroud further includes at least one cavity for receiving a sight accessory affixed to the slide of the firearm.

In some embodiments, the sight accessory comprises an optic.

In some embodiments, the shroud defines at least one cut-out section to avoid interference with a sight accessory affixed to the slide of the firearm.

In some embodiments, the shroud further includes at least one raised panel to avoid interference with a sight accessory affixed to the slide of the firearm.

Other embodiments of the present invention are directed to a method for holstering a firearm. The method includes pulling a slide of the firearm to a fully retracted position relative to a grip of the firearm, engaging a lock lever of the firearm with a detent of the slide to retain the slide in the fully retracted position, inserting a muzzle end of the slide into a shroud of a holster until the muzzle end of the slide contacts a slide block of the shroud, and rotating the grip of the firearm such that the slide aligns with the shroud of the holster. The shroud is configured to contact the lock lever of the firearm during insertion of the slide into the shroud such that the lock lever disengages from the detent of the slide, thereby allowing the slide to move from a fully retracted position to a partially retracted position.

In some embodiments, the method further includes inserting a locking bar into a locking pin aperture of the shroud to prevent forward motion of the grip relative to the slide block.

In some embodiments, the method further includes, prior to pulling the slide of the firearm to the fully retracted position, at least partially ejecting a magazine from the grip, and after rotating the grip of the firearm such that the slide aligns with the shroud of the holster, re-seating the magazine in the grip.

Other embodiments of the present invention are directed to a holster including a belt mount and a shroud mounted to the belt mount. The shroud includes a channel adapted to receive a slide of a firearm, a slide block extending into an open portion of the channel and configured to abut a muzzle end of the slide received in the channel to prevent forward movement of the slide, and a locking lug extending into the open portion of the channel and configured to engage a chamber of the slide to prevent movement of the slide.

In some embodiments the shroud further includes a protuberance configured to contact a lock lever of the firearm during insertion of the firearm into the shroud such that the lock lever disengages from the slide, thereby allowing the slide to move from a fully retracted position to a partially retracted position.

In some embodiments, the belt mount includes an L-shaped bracket adjustably mounted to the shroud and configured to receive a belt through a portion of the belt mount.

In some embodiments, the belt mount includes a belt drag knob adapted to press against the belt received through the belt mount, thereby retaining the belt in the belt mount.

In some embodiments, the holster further includes a wrench configured to be carried in the belt mount. The wrench is configured to secure and remove fasteners connecting the belt mount to the shroud.

In some embodiments the belt mount includes one or more side holes configured to receive fasteners for adjusting a cant of the shroud relative to a belt of a user.

In some embodiments, the shroud is made by folding a substantially flat piece of material to define the channel adapted to receive the slide of the firearm.

Other embodiments of the present invention are directed to a belt retainer adapted to receive a belt therethrough. The belt retainer includes a magnetic holding pad adapted to retain a wrench. The magnetic hold pad includes a magnet adapted to magnetically attract the wrench to the holding pad and a funnel adapted to retain the wrench.

The embodiments discussed herein may provide a user with an ambidextrous, quickly detachable, and lockable holster. The embodiments of the present disclosure provide significant advances in safety and speed of drawing and re-holstering, as well as being able to micro-adjust the shown holsters to the specifics of a user's body, preferences, and strong side hand. The disclosed embodiments are ambidextrous in assembly and permit a firearm to be drawn from either hand, regardless of holster positioning, from the locked position. For example, a user may have a firearm holstered on his/her right side, but the described embodiments may permit the user to draw the firearm with either the user's right or left hand, such as permitted by the holstering and drawing mechanisms and methods shown and described in U.S. Pat. No. 6,755,331 to Rassias and U.S. Pat. No. 8,215,525 to Rassias, both of which are incorporated herein by reference in their entirety. The disclosed embodiments may also be adjusted to accommodate unencumbered access while wearing body armor or other heavy equipment, including, for example, thigh-mounted units. Further detail will become apparent upon review of the attached drawings and accompanying descriptions.

DESCRIPTION OF THE INVENTION

Figure 1:
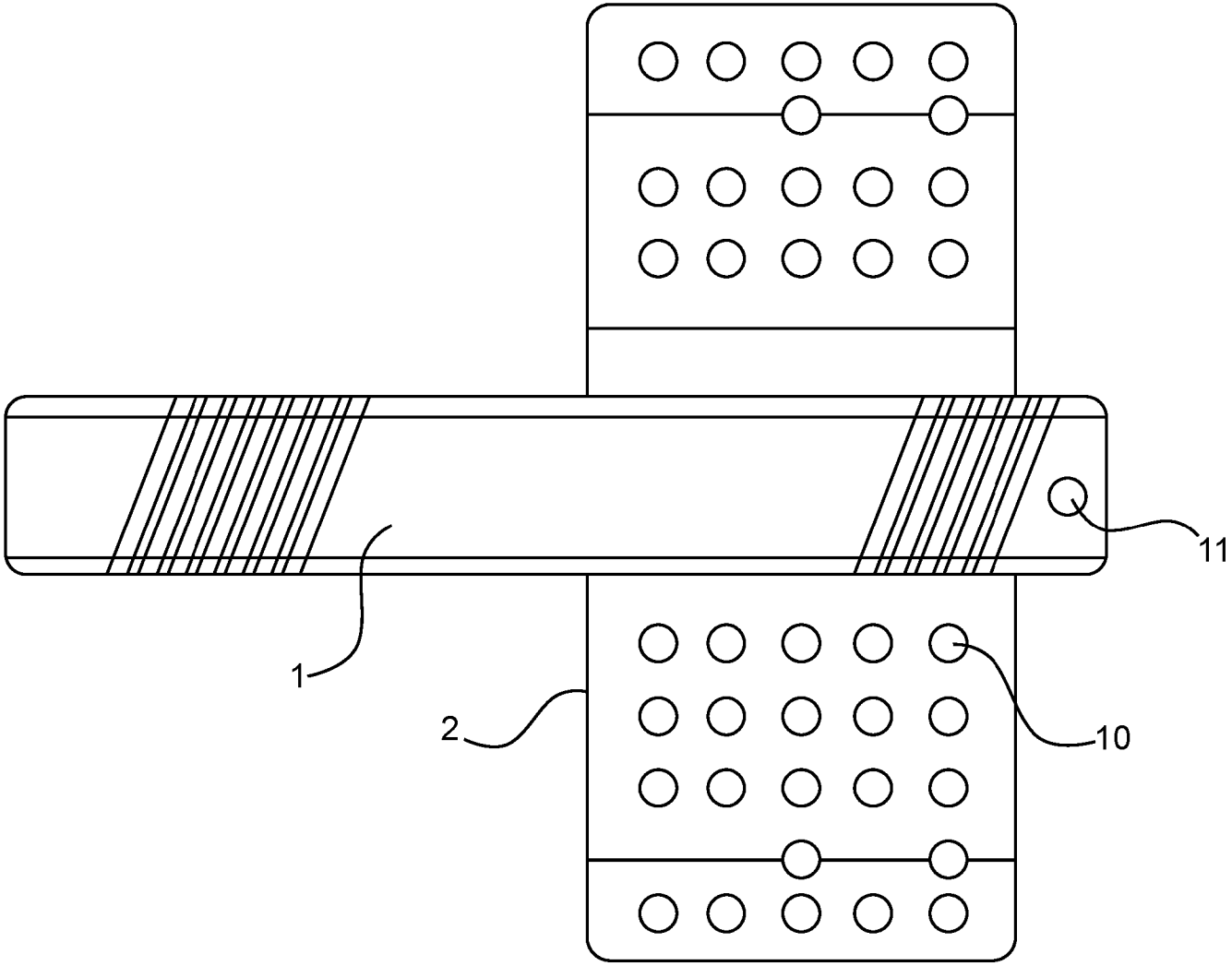
FIG. 1 is a side view of a holster shroud and hip plate assembly according to an embodiment of the present invention.

As used herein, spatial or directional terms, such as "inner", "outer", "left", "right", "up", "down", "horizontal", "vertical", "lateral", "forward", "backward", "rearward", and the like, relate to the invention as it is shown in the drawing figures. However, it is to be understood that the invention can assume various alternative orientations and, accordingly, such terms are not to be considered as limiting. It is also to be understood that the specific apparatuses and configurations illustrated in the attached drawings and described in the following specification are simply exemplary embodiments of the invention. Hence, specific dimensions and other physical characteristics related to the embodiments disclosed herein are not to be considered as limiting, unless otherwise indicated.

It is noted that, as illustrated, the safety holster is shown in a right-side carry configuration. However, it is to be understood that a left-side carry configuration is also within the scope of the present invention and could be achieved by mirroring certain components of the safety holster, as will be readily appreciable by one skilled in the art.

As used herein, the term "at least one of" is synonymous with "one or more of". For example, the phrase "at least one of A, B, and C" means any one of A, B, and C, or any combination of any two or more of A, B, and C. For example, "at least one of A, B, and C" includes one or more of A alone; or one or more B alone; or one or more of C alone; or one or more of A and one or more of B; or one or more of A and one or more of C; or one or more of B and one or more of C; or one or more of all of A, B, and C. Similarly, as used herein, the term "at least two of" is synonymous with "two or more of". For example, the phrase "at least two of D, E, and F" means any combination of any two or more of D, E, and F. For example, "at least two of D, E, and F" includes one or more of D and one or more of E; or one or more of D and one or more of F; or one or more of E and one or more of F; or one or more of all of D, E, and F.

Figure 2:
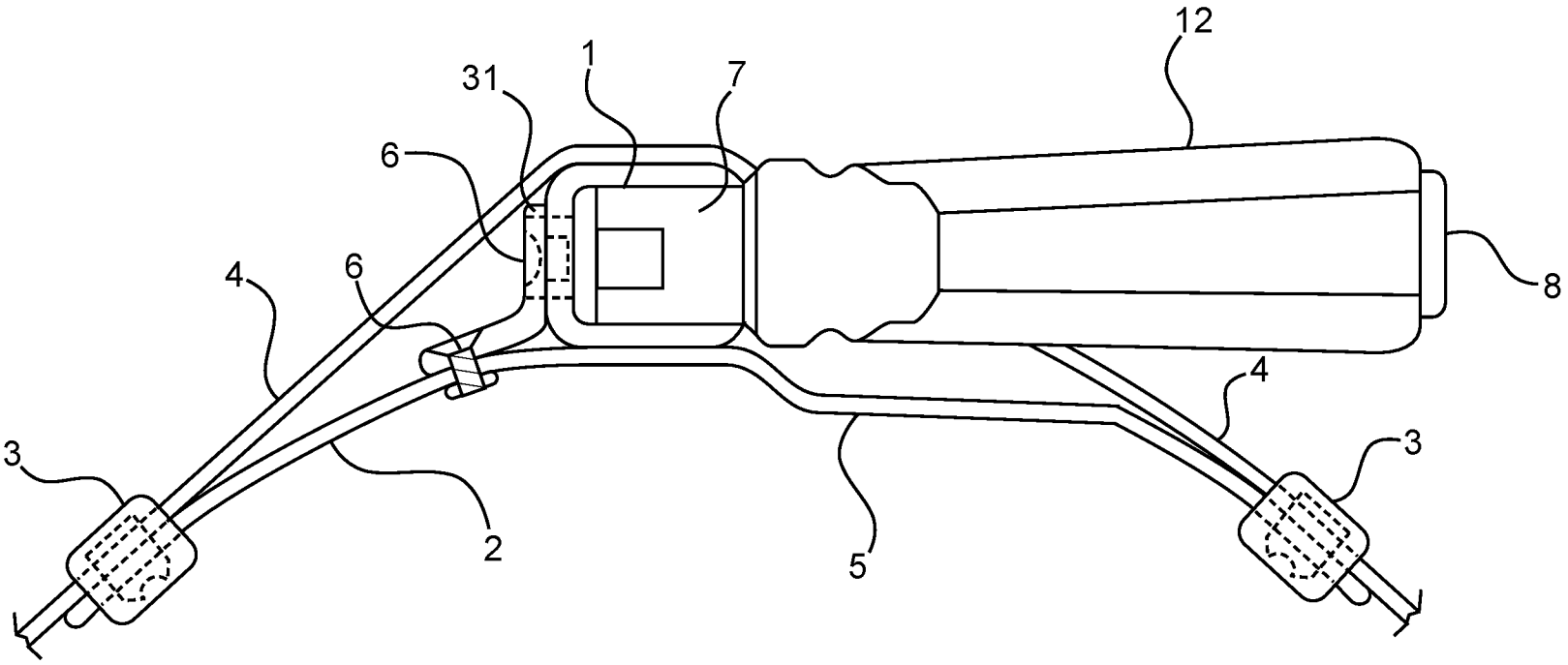
FIG. 2 is a top view of the holster shroud and hip plate assembly of FIG. 1, shown attached to a belt and with a firearm inserted in the shroud.

Embodiments of the present invention are generally directed to a safety holster which prevents a firearm from being holstered with a round in the chamber but can automatically chamber a round upon drawing the firearm from the holster. Referring now to FIGS. 1-2, a safety holster according to an embodiment of the present invention may include a holster shroud 1 mounted to a holster hip plate 2. The shroud 1 includes a generally U-shaped channel adapted to receive a slide 7 of a firearm within the open side of the U-shaped cross section of the shroud 1. The shroud 1 may be removably mounted to the hip plate 2 such that a user can remove the shroud 1 with a firearm inserted therein from the hip plate 2 as a unit. For example, the shroud may be mounted to the hip plate 2 with pins or similar fasteners readily accessible and rapidly disconnectable from the hip plate 2. Further details of the connection of the shroud 1 to the hip plate 2 will be described hereinafter with reference to FIGS. 6A-6B.

With continued reference to FIG. 1, the shroud 1 may include a locking pin aperture 11 into which a locking rod or bar may be inserted to prevent unauthorized use of a firearm in the shroud 1. Specifically, the locking pin aperture 11 may be positioned slightly forward of the muzzle of a firearm inserted in the shroud 1 so that the locking rod or bar inserted through the locking pin aperture 11 prevents forward movement of the muzzle and grip 12 of the firearm which, as will be described hereinafter is necessary to remove the firearm from the shroud 1. Further details and alternative embodiments of the locking pin aperture 11 and the cooperating locking rod or bar will be shown and described hereinafter with reference to FIGS. 5C-5D.

With continued reference to FIG. 1, the shroud 1 may be made to tightly fit against a firearm holstered therein to minimize the size of the shroud 1. Accordingly, weight of the shroud 1 may also be minimized and the shroud may be more readily concealed against the body of a user.

The hip plate 2 may include a plurality of mounting holes 10 for attaching additional components and accessories to the hip plate 2. For example, some of the plurality of mounting holes 10 may be utilized to attach belt retainers (as shown in FIG. 2) for connecting the hip plate 2 to a user's belt. The plurality of mounting holes 10 may be arranged on the hip plate 2 to facilitate multiple positions of the belt retainers on both sides of the hip plate 2 to accommodate outside the waistband (OTWB) carry, inside the waistband (ITWB) carry, and/or appendix inside the waistband carry (AIWB) carry. The plurality of mounting holes 10 may also be arranged to facilitate angular mounting of the belt retainers such that the user may adjust the angle of the belt retainers to achieve a desired position of the shroud 1 for comfort and/or rapid unholstering of the firearm.

Referring now to FIG. 2, the shroud 1 and hip plate 2 are shown attached to a belt 4 worn by a user. The hip plate 2 is secured to the belt 4 via belt retainers 3 attached to various mounting holes 10 on either side of the hip plate 2. The hip plate 2 may include an angled portion 5 at which the shroud 1 is mounted to the hip plate 2 to contour to the shape of the user's waist. The shroud 1 may be mounted to the hip plate 2 via fasteners 6, such as screws, which engage threaded holes or threaded inserts 31 in the shroud 1 and/or the hip plate 2. With the belt 4 tightened around the user's waist, the belt 4 wraps taut against the shroud 1. If the shroud 1 and hip plate 2 are worn by the user in an ITWB carry position, the waistband of the user's pants may be sandwiched between the belt 4 and the shroud 1.

FIG. 2 shows a firearm, particularly a pistol, inserted in the shroud 1. The slide 7 of the firearm is inserted into the shroud 1 such that a grip 12 of the firearm extends substantially parallel to at least a portion of the hip plate 2 and the receiver 7 faces upwards. The firearm may or may not be loaded with a magazine 8 when inserted into the shroud 1.

Figure 3:
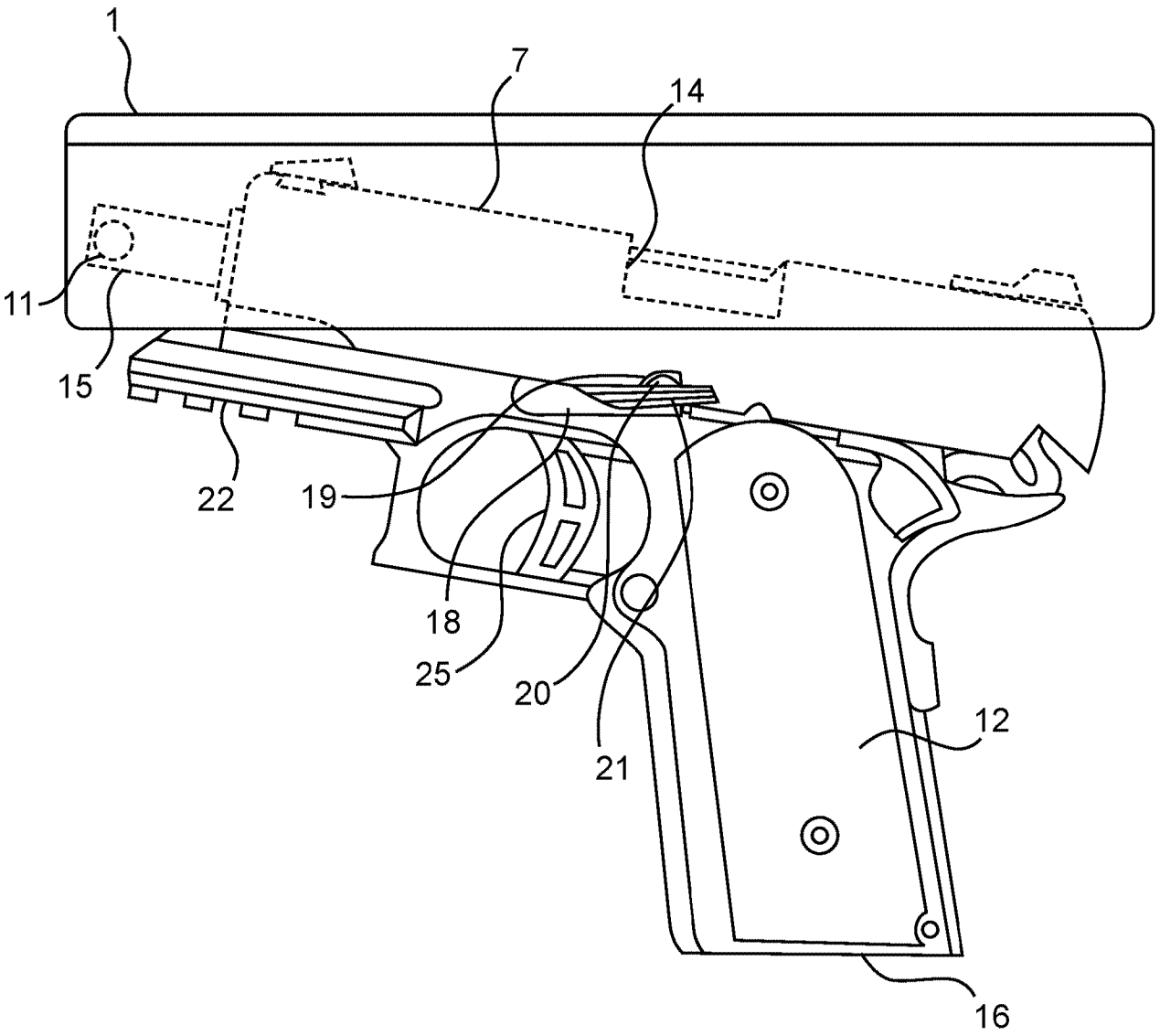
FIG. 3 is a side view of the holster shroud of FIG. 1, with a firearm partially inserted in the shroud.
Figure 4:
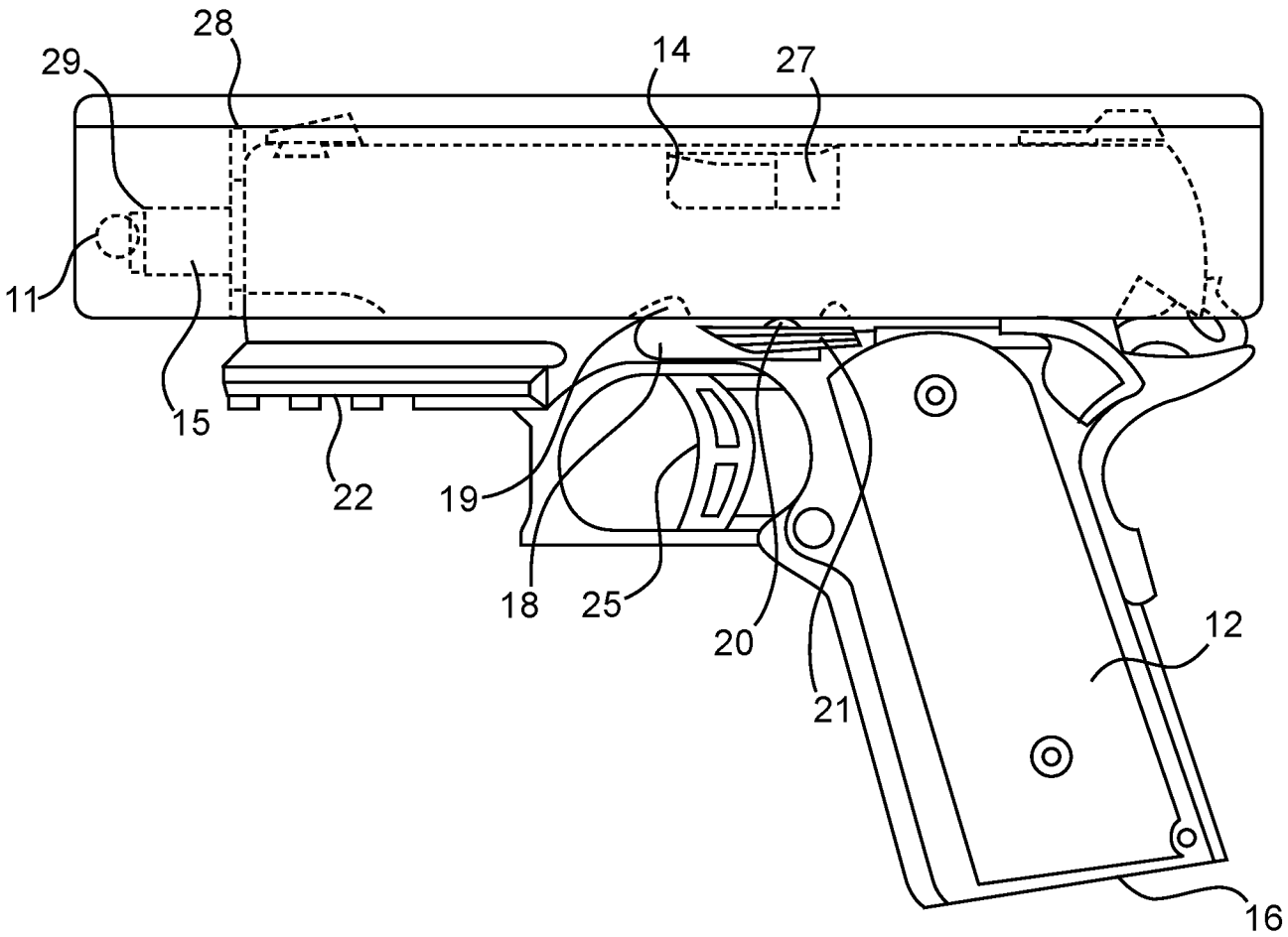
FIG. 4 is a side view of the holster shroud of FIG. 1, with a firearm fully inserted in the shroud and a magazine loaded in the firearm.

Referring now to FIG. 3-4, the firearm is inserted into the shroud 1 with the slide 7 initially in a fully retracted (or locked) position. On most pistols suitable for use with the holster of the present invention, the slide 7 is locked in the fully retracted position by a tab 20 of a slide lock lever 18 engaging a detent 19 in the slide 7. More particularly, the slide lock lever 18 includes a thumb actuator 21 which the user may press toward the slide 7 such that when the user manually pulls the slide 7 back relative to the grip 12, the tab 20 of the slide lock lever 18 aligns with and snaps into the detent 19 of the slide 7 holding the slide 7 in the fully retracted position. With the slide 7 in the fully retracted position, a muzzle 15 of the firearm is exposed and a trigger 25 of the firearm is rendered inoperable. Additionally, moving the slide 7 to the fully retracted position automatically ejects any round present in a chamber 14 of the firearm. The user may manually disengage the slide 7 from the fully retracted position by pressing down on the thumb actuator 21 of the slide lock lever 18 to disengage the tab 20 from the detent 19, thereby allowing the slide 7 to spring forward over the muzzle 15.

With continued reference to FIG. 3 and additional reference to FIG. 4, the firearm may be inserted into the shroud 1 at an angle (as shown in FIG. 3) while in the fully retracted position such that the muzzle end of the firearm enters a forward end of the shroud 1. The firearm may be pressed forward into the shroud 1 until the slide 7 abuts a forward slide block 28 extending at least partially between opposite sides of the U-shaped cross section of the shroud 1. The muzzle 15, which extends beyond the slide 7 with the slide in the fully retracted position, is permitted to pass through an open central section of the forward slide block 28 while a peripheral section of the forward slide block 28 abuts the slide 7. The forward slide block 28 prevents further forward movement of the firearm in the shroud 1. At this point, the firearm may be rotated until the slide 7 is substantially parallel to the shroud 1, as shown in FIG. 4. As the firearm is rotated into the shroud 1, the shroud 1 contacts the slide lock lever 18 such that continued rotation of the firearm disengages the tab 20 of the slide lock lever 18 from the detent 19 of the slide 7. The shroud 1 may include a specially designed notch for contacting and disengaging the tab 20 from the detent 19. With the tab 20 disengaged from the detent 19, the grip 12 is allowed to move forward relative to the slide 7 to a partially retracted position. In the partially retracted position (as shown in FIG. 4), the firearm remains out of battery and incapable of firing, thereby preventing accidental or unauthorized discharge of the firearm.

Figure 5B:
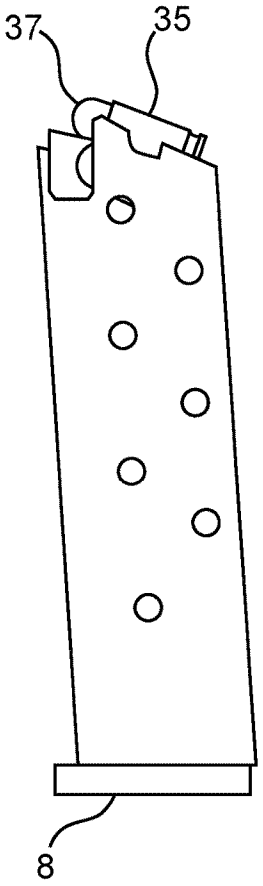
FIG. 5B is side view of the magazine of FIG. 5A
Figure 5A:
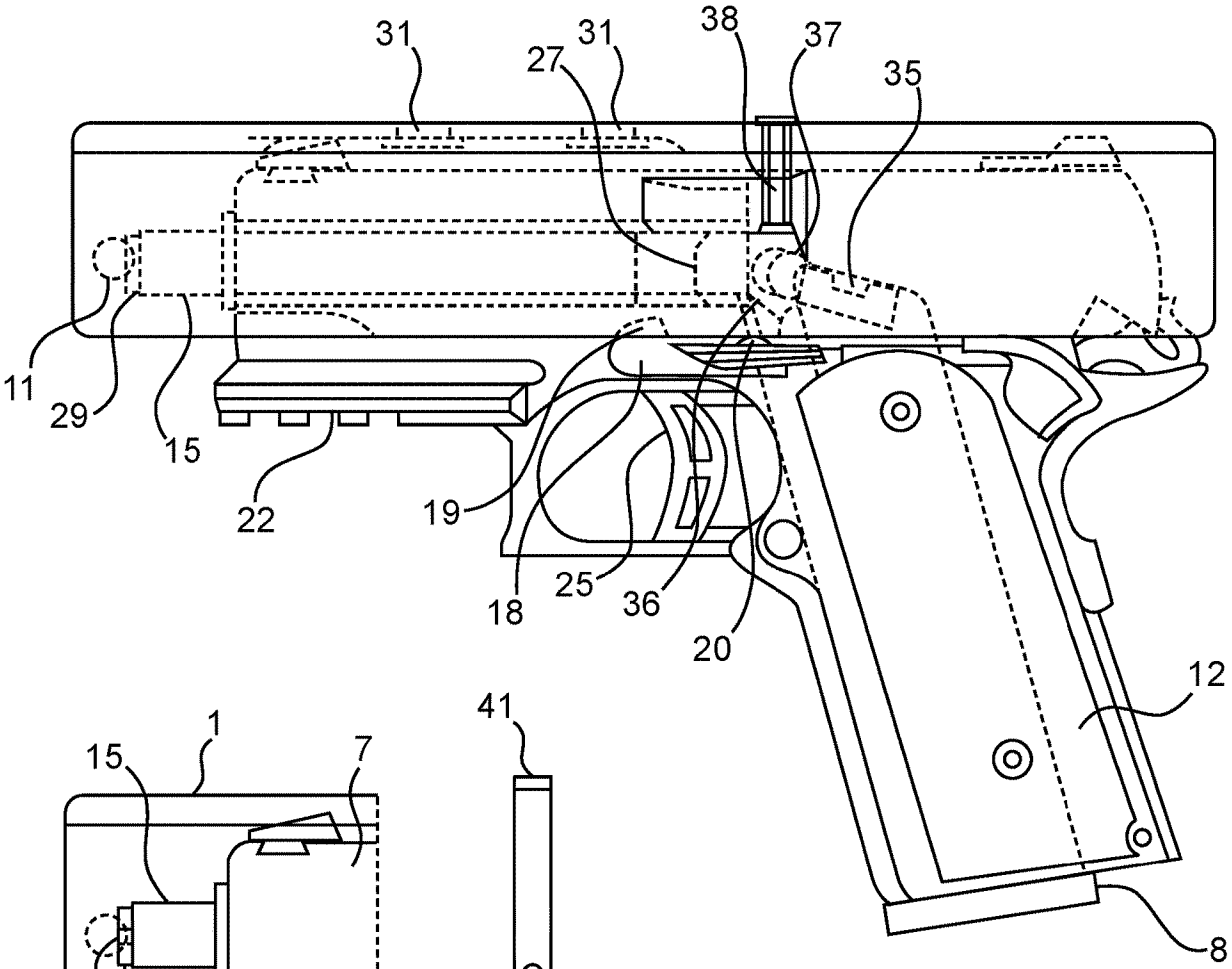
FIG. 5A is a side view of the holster shroud of FIG. 1, with a firearm fully inserted in the shroud and a magazine loaded in the firearm.

With continued reference to FIG. 4 and further reference to FIG. 5A, the shroud 1 includes a locking lug 27 which extends into the opening of the shroud 1 and fits into the chamber 14 of the firearm as the firearm is rotated into the shroud 1. The locking lug 27 may be positioned and retained in the shroud 1 by a fastener 38, such as a bolt. In other embodiments, the locking lug 27 may be integrally formed with the shroud 1. With the firearm fully seated in the shroud 1, the locking lug 27 provides a physical stop preventing forward movement of the slide 7 into a battery position by abutting at least one edge or surface of the chamber 14 of the firearm. If the firearm includes a loaded magazine 8, as shown in FIG. 5A, the locking lug 27 engages the bullet 37 of the top round 35 of the magazine 8 to prevent the top round 35 from sliding up a feed ramp 36 of the firearm. As such, the round 35 cannot enter the chamber 14. In this manner, the locking lug 27 prevents the firearm from being in battery and ready to fire while the firearm is in the shroud 1. The locking lug 27 also prevents the firearm from being fully seated in the shroud 1 if a round is already in the chamber 14, thus providing tactile feedback reminding the user to clear the chamber 14 prior to holstering the firearm. To draw the firearm, the grip 12 may be rotated away from the shroud, opposite the direction of insertion, such that the slide 7 is allowed to move forward unobstructed by the locking lug 27 into a battery position. Movement of the slide 7 allows the top round 35 to enter the chamber 14 via the feed ramp 36. The firearm may then be fired as normal.

As shown in FIGS. 3-5A, the shroud 1 may be at least partially open on the underside of the muzzle 15 of the firearm such that an accessory rail 22 of the firearm, along with any lights or other accessories affixed to the accessory rail 22, may be unobstructed by the shroud 1.

Figure 5D:
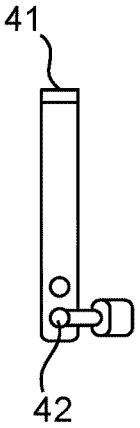
FIG. 5D is a side view of a muzzle locking bar according to another embodiment of the present invention.
Figure 5C:
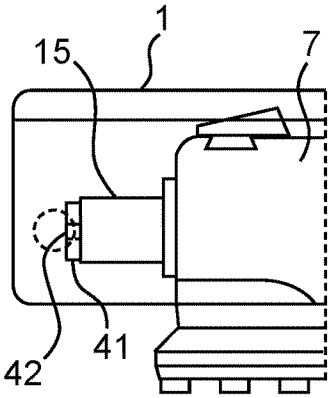
FIG. 5C is a side view of the muzzle end of a holster shroud according to another embodiment of the present invention.

Referring now to FIGS. 5C-5D, the locking pin aperture 11 of the shroud 1 may be located approximately adjacent to and forward of the muzzle 15 of the firearm when the firearm is fully inserted in the shroud 1 and in the partially retracted position (as shown in FIG. 4). A rod or bar inserted through the locking pin aperture 11 may thus abut an end surface 29 of the muzzle 15, thus preventing forward movement of the muzzle 15 and the grip 12 in the direction of the forward slide block 28. In some embodiments, the locking pin aperture 11 and the cooperating rod may be round such that the muzzle 15 contacts the rod at a point tangent to the rod. In other embodiments, such as that shown in FIG. 5C-5D, the locking pin aperture 11 and the cooperating bar 41 may be rectilinear such that the bar 41 contacts the muzzle 15 over the entire or a partial diameter of the muzzle 15, increasing the contact area of the muzzle 15 against the bar 41. The rectilinear bar 41 also reduces the necessary size of the locking pin aperture 11, thereby allowing the length of the shroud to be reduced.

The bar 41 may include a locking device 42 pivotally coupled to an end of the bar 41. The locking device 42 may be rotatable to secure the bar 41 in the locking pin aperture 11 of the shroud 1, thereby preventing unauthorized removal of the bar 41. In some embodiments, the locking device 42 may be coupled to the bar with a ball bearing to facilitate rotation of the locking device 42 relative to the bar 41. By having the locking device 42 permanently connected to the bar 41, the number of components required to secure to the bar 41 to the shroud 1 is reduced.

Figure 6A:
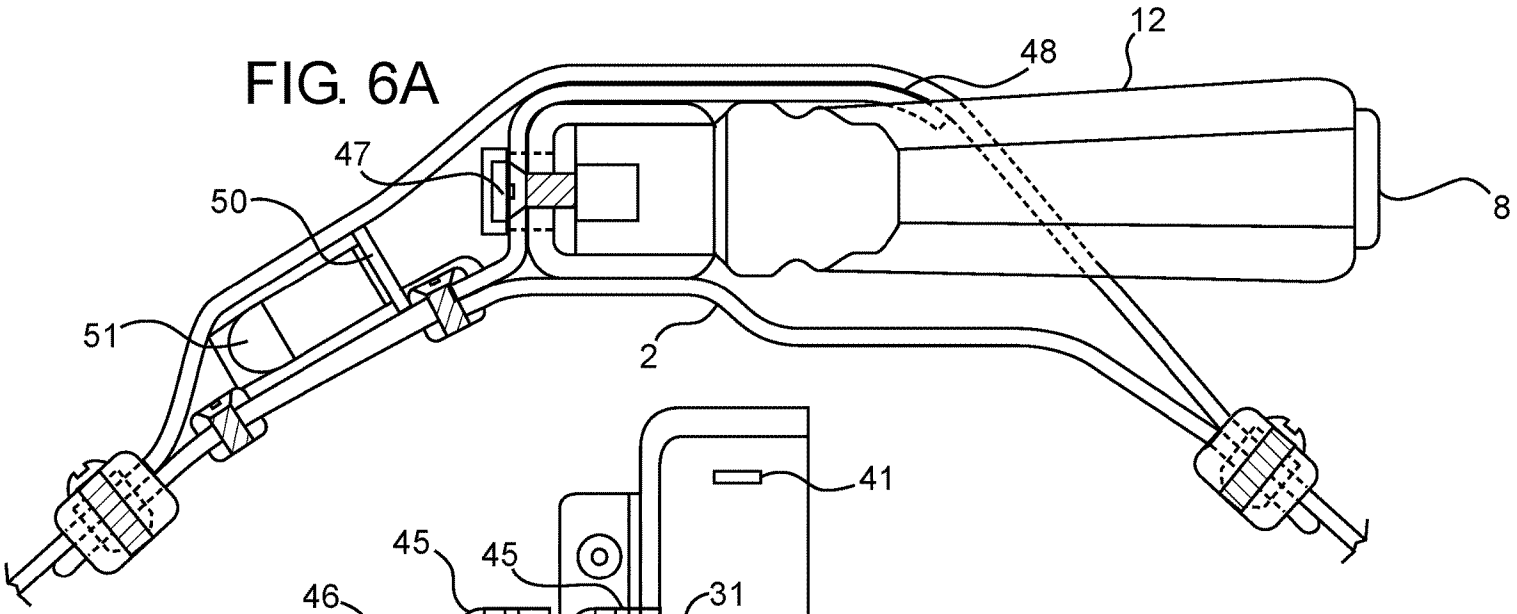
FIG. 6A is a top view of the holster shroud and hip plate assembly of FIG. 1, shown attached to a belt, with a firearm inserted in the shroud, and with a magazine loaded in the firearm.
Figure 6B:
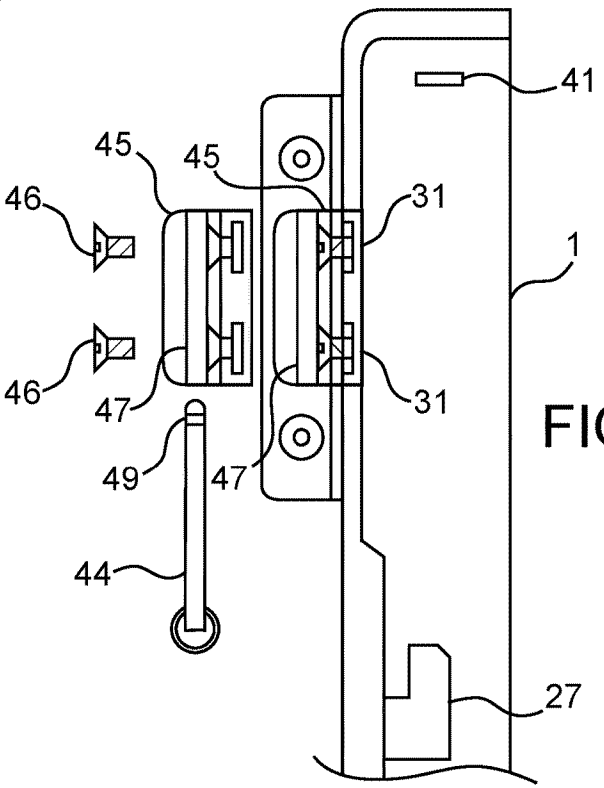
FIG. 6B is a side view of the holster shroud of FIG. 6A.

FIGS. 6A-6B illustrates various customizable features of the hip plate 2. In some embodiments, the hip plate 2 may include an extension plate 48 protruding in the direction of the grip 12 of the firearm to protect accessories mounted to the accessory rail 22 (see FIGS. 3-5A). In some embodiments, a spare magazine carrier 50 may be attached to the hip plate 2 via the plurality of mounting holes 10. The spare magazine carrier 50 may hold a magazine 8 loaded with rounds 51. As discussed above with respect to FIGS. 1-2, the shroud 1 may be removably mounted to the hip plate 2. This allows the user to remove the shroud 1 along with the firearm while keeping the firearm locked in the shroud 1 to prevent unauthorized use of the firearm.

The shroud 1 may be attached to the hip plate 2 via a clevis bar 44 to facilitate rapid and simple removal and reattachment of the shroud 1 to and from the hip plate 2. A clevis stanchion 45 defining a clevis channel 47 may be attached to the shroud 1 via fasteners 46, such as screws. In other embodiments, the clevis stanchion 45 may be integrally formed with the shroud 1. The clevis stanchion 45 may cooperate with a stanchion on the hip plate 2 such that the shroud 1 is secured to the hip plate 2 when the clevis bar 44 is inserted through the clevis stanchion 45 of the shroud 1 and the cooperating stanchion of the hip plate 2. The clevis bar 44 may be inserted substantially vertical and parallel to the shroud 1, though other attachment configurations will be appreciated by those skilled in the art and fall within the scope of the present invention. The clevis bar 44 may define a cross-drilled hole 49 adapted to receive a keylock to prevent unauthorized removal of the shroud 1 from the hip plate 2. Further descriptions and alternative arrangements of the clevis bar 44, the clevis stanchion 45, and the arrangement and functionality thereof can be found in U.S. Pat. No. 8,215,525 to Rassias and International Patent Application Publication No. WO 2017/124072 to Rassias, the disclosures of which are hereby incorporated by reference in their entirety. In alternative embodiments, the shroud 1 may be semi-permanently attached to the hip plate 2, for example via fasteners which require a tool to remove. An example of such a connection between the shroud 1 and the hip plate 2 may be found in U.S. Pat. No. 6,755,331 to Rassias, the disclosure of which is hereby incorporated by reference in its entirety.

Figure 7:
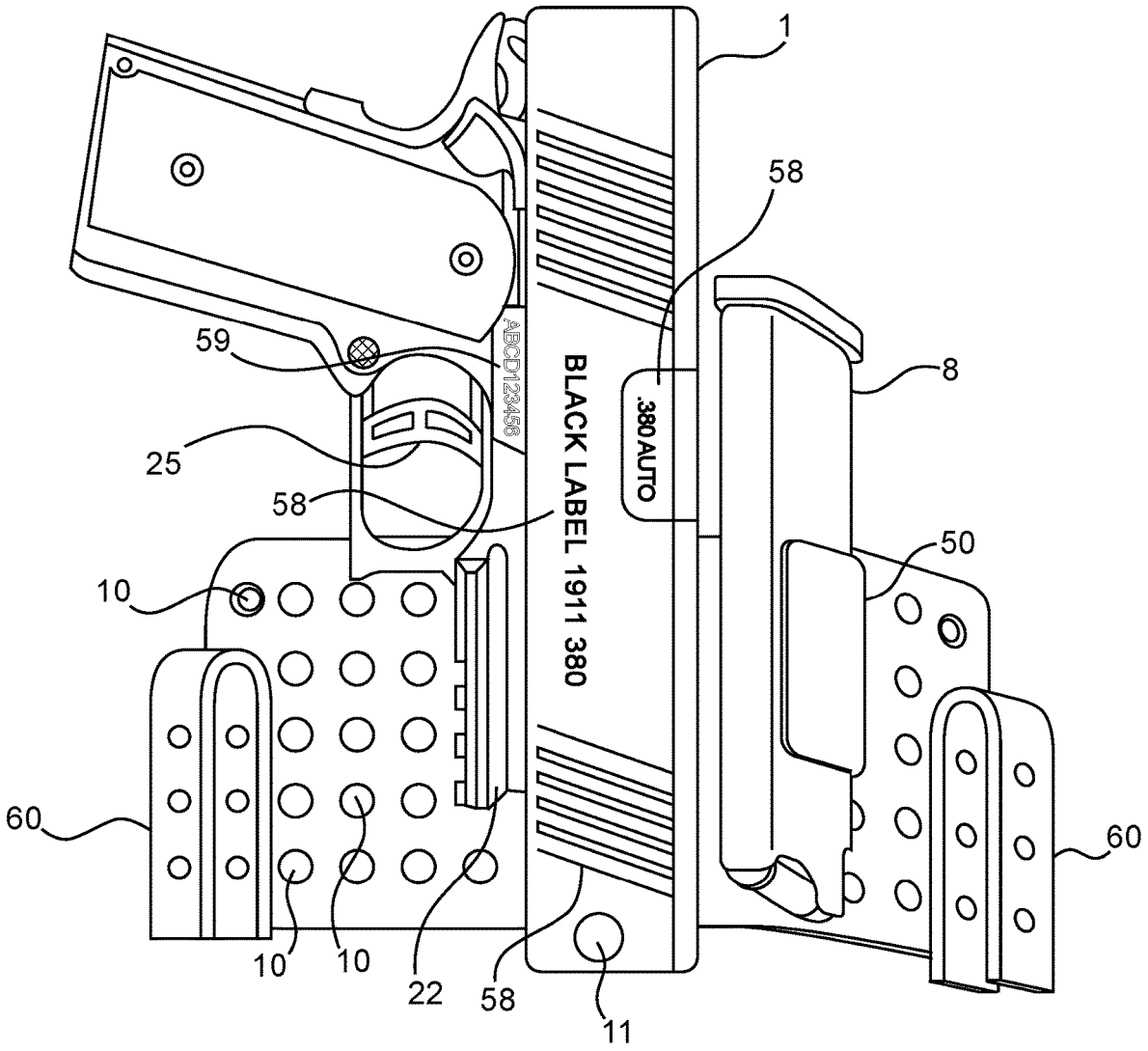
FIG. 7 is a side view of the holster shroud and hip plate assembly of FIG. 1, shown with a firearm inserted in the shroud.

Referring now to FIG. 7, the shroud 1 may be designed to mimic aesthetic features 58, such as engravings and reliefs, of the slide 7 so that the firearm may be readily identified while in the shroud 1. In some embodiments, the shroud 1 may be designed, or include a cutout, to facilitate viewing of a serial number 59 engraved or printed on the firearm while in the shroud 1. In some embodiments, reversible belt retainers 60 for connection to the belt 4 (see FIGS. 2 and 6A) may be mounted to the hip plate 2 via the plurality of mounting holes 10. In the arrangement shown in FIG. 7, the reversible belt retainers 60 are shown attached to the same side of the hip plate 2 as the shroud 1. With this arrangement, the belt 4 passes through the belt retainers 60 and over the shroud 1 such that, when worn by the user, the shroud 1 is located between the user's body and the belt. The reversible belt retainers 60 may alternatively be mounted to the side of the hip plate 2 opposite the shroud 1 such that, when worn by the user, the shroud 1 is located farther away from the user's body than the belt 4.

Having described the structure and function of various embodiments of the safety holster, a method of holstering a firearm will now be described. The method ensures that the firearm is not unintentionally holstered with a round in the chamber 14. First, the magazine 8 is at least partially ejected from the grip 12 of the firearm via manual operation of the magazine release button or control of the grip 12. The user then manually pulls the slide to the fully retracted position and presses the thumb actuator of the slide lock lever 18 to engage the tab 20 with the detent 19 of the slide 7. The user may then insert the firearm into the shroud 1 substantially as described above by first moving the firearm forward and at an angle until the slide 7 contacts the forward slide block 28. The grip may then be rotated toward the shroud 1 to fully seat the slide in the shroud 1, such that the shroud 1 contacts and disengages the tab 20 of the slide lock lever 18 from the detent 19 of the slide 7. The slide 7 is then permitted to move forward relative to the grip 12, as described above, until the rear of the chamber 14 engages the locking lug 27 of the shroud. The firearm is now in the partially retracted position and remains incapable of discharging a round even if the magazine 8 is re-seated into the grip 12. The bar 41 may then be inserted into the locking pin aperture 11, and the bar 42 may be locked in place if desired. The firearm is now safely secured in the shroud 1.

If one-handed holstering of the firearm is desired, the magazine 8 may not be fully removed from the grip 12. Instead, the user may actuate the magazine release button or control to partially eject the magazine 8 from the grip 12 but leave the magazine floating in the grip 12 while the remaining steps of holstering the firearm are performed. With the firearm seated in the shroud 1, the user may then simply press the magazine 8 forward to re-seat the magazine in the grip 12.

Removal of the firearm from the shroud 1 is simply the opposite of the above-described steps. The bar 42 is unlocked to allow forward movement of the muzzle 15 and the grip 12 of the firearm. The grip 12 is pressed slightly forward toward the forward slide block 28, and then the grip 12 is rotated away from the shroud 1 such that the locking lug 27 disengages from the chamber of the slide 7. The slide 7 is thus permitted to move forward relative to the grip 12 into a battery position. The forward action of the slide 7 relative to the grip 12 causes the top round 35 of the magazine 8 to be chambered and the trigger 25 to be activated. The firearm may then be fired as normal.

Figure 8A:
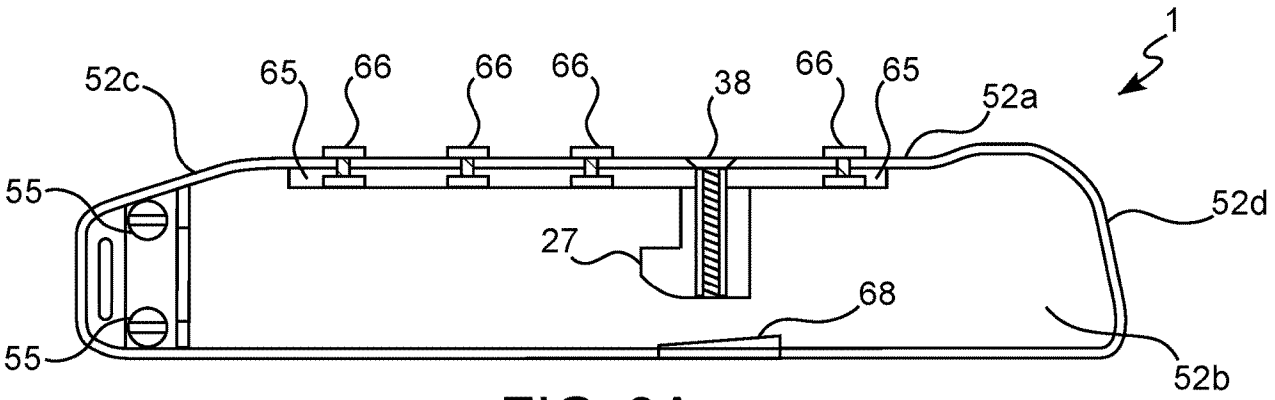
FIG. 8A is a side cross section view of a holster shroud according to an embodiment of the present invention.
Figure 8B:
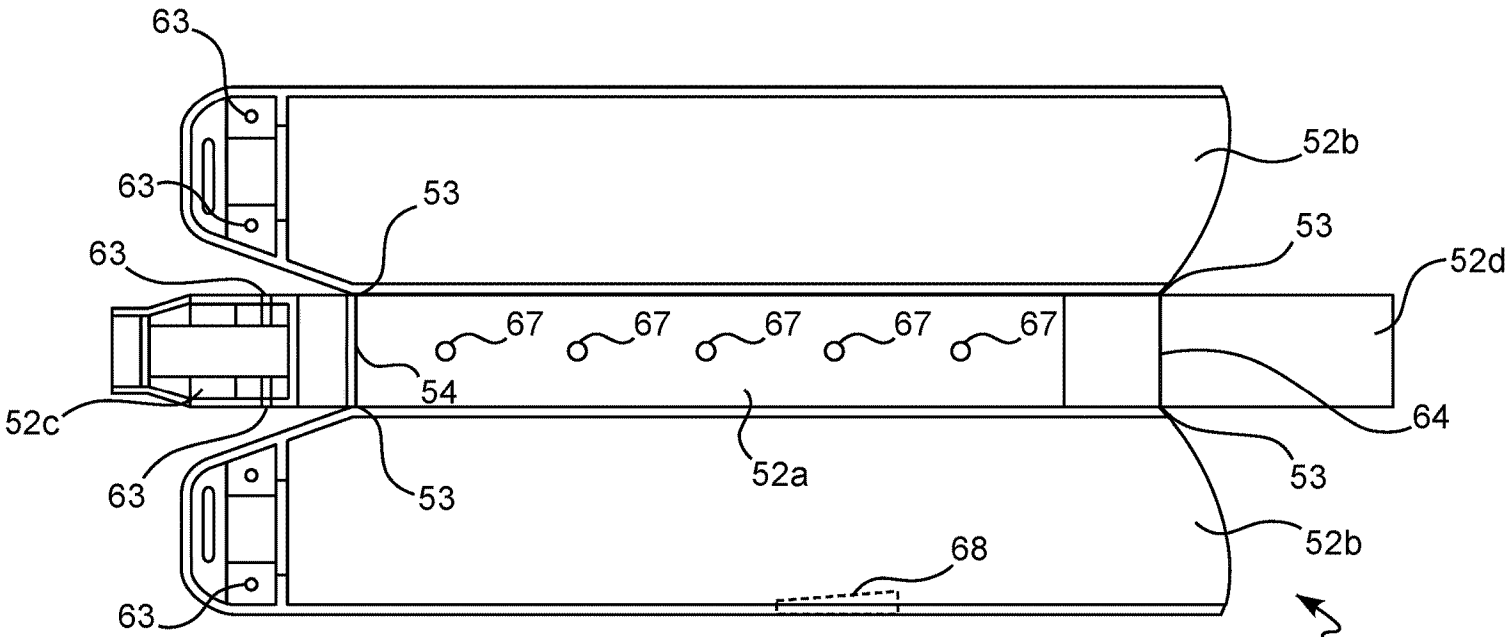
FIG. 8B is a top view of the holster shroud of FIG. 8A prior to forming.

Referring now to FIGS. 8A-8B, the shroud 1 may be made from a flat piece or pieces of material folded to form the U-shaped channel discussed above with reference to FIGS. 1-2. As shown in FIG. 8B, the top 52*a*, sides 52*b*, front 52*c*, and rear 52*d* of the shroud 1 may be cut from a flat or substantially flat piece of material to from a two-dimensional profile of the shroud 1. The sides 52*b* may be foldable relative to the top 52*a* of the shroud 1 along corresponding folding points 53 extending along the joint between the sides 52*b* and the top 52*a*. The folding points 53 may have a reduced material thickness relative to the remainder of the material to induce bending at the folding points 53. The material may be heated to facilitate folding of the sides 52*b* relative to the top 52*a*.

In a similar manner, a front folding point 54 may extend along the joint between the front 52*c* of the shroud 1 and the top 52*a* of the shroud 1. The front folding point 54 may have a reduced material thickness relative to the remainder of the material to induce bending at the front folding point 54. The material may be heated to facilitate folding of the front 52*c* relative to the top 52*a*. Corresponding holes 63 in the sides 52*b* and the front 52*c* of the shroud 1 may align after the sides 52*b* and the front 52*c* of the shroud 1 are folded into position relative to each other and relative to the top 52*a* of the shroud 1. Fasteners 55, such as screws or bolts, may be inserted through the holes 63 of the sides 52*b* and the front 52*c* of the shroud 1 to secure the shroud 1 in the folded position.

The rear 52*d* of the shroud 1 may be bent relative to the top 52*a* of the shroud 1 about a folding point 64, in a similar manner to the sides 52*b* and front 52*c*. However, the rear 52*d*, as shown in FIGS. 8A-8B, may be folded into a gradual curve rather than a square or rectilinear joint. The rear 52*d* may be glued to the sides 52*b* once in the folded position.

With continued reference to FIGS. 8A-8B, a mounting spline 65 may be fastened to the top 52*a* of the shroud 1 to facilitate mounting of the locking lug 27 and other holster components. The mounting spline 65 may include a plurality of threaded holes which align with receiving holes 67 in the top 52*a* of the shroud 1 such that fasteners 66, such as screws, may be threaded into the mounting spline 65 to secure the mounting spline 65 to the shroud 1. In other embodiments, the mounting spline 65 may be mounted to the top 52*a* of the shroud 1 with rivets or other types of fasteners. The locking lug 27 may be fastened to the mounting spline 65 in a similar manner by fastener 38.

With continued reference to FIGS. 8A-8B, a molded protuberance 68 may be formed on the side 52*b* of the shroud 1 corresponding to the slide lock lever 18 of the firearm. The protuberance 68 is positioned on the side 52*b* of the shroud such that the protuberance 68 engages the slide lock lever 18 as the firearm is inserted into the shroud 1, releasing the slide 7 of the firearm from the fully retracted position. As described above with reference to FIGS. 3-4, releasing the slide 7 allows the grip 12 of the firearm to move forward to the partially retracted position in which the firearm is holstered in the shroud 1.

Figure 9:
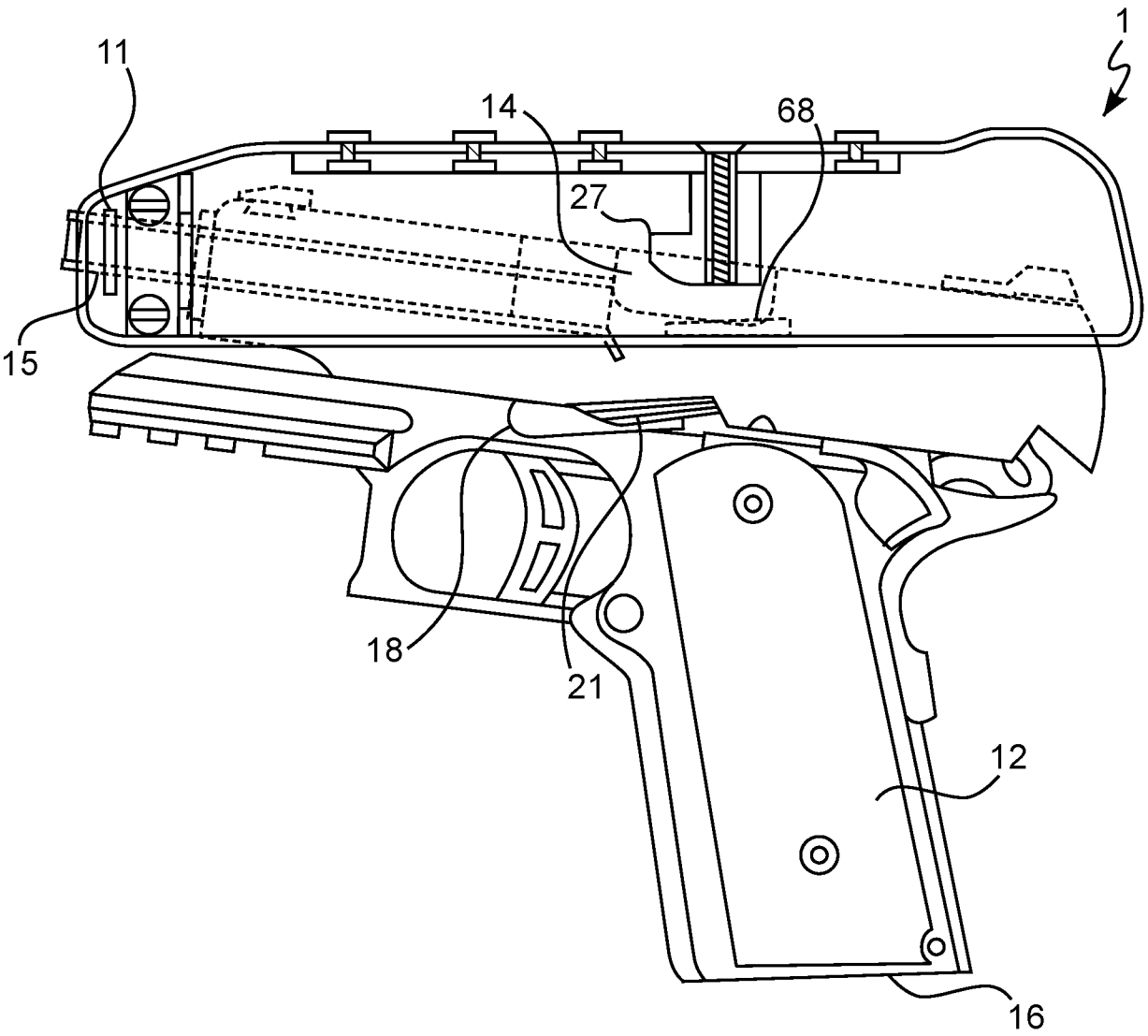
FIG. 9 is a side view of the holster shroud of FIG. 8A, with a firearm partially inserted in the shroud.

Referring now to FIG. 9, the shroud 1 is shown with the firearm partially inserted, prior to the protuberance 68 engaging the thumb actuator 21 of the slide lock lever 18. As the firearm is in the fully retracted position, the muzzle 15 of the firearm extends forward of the locking pin aperture 11. The locking lug 27 extends from the shroud 1 toward the open chamber 14 of the firearm.

Figure 10:
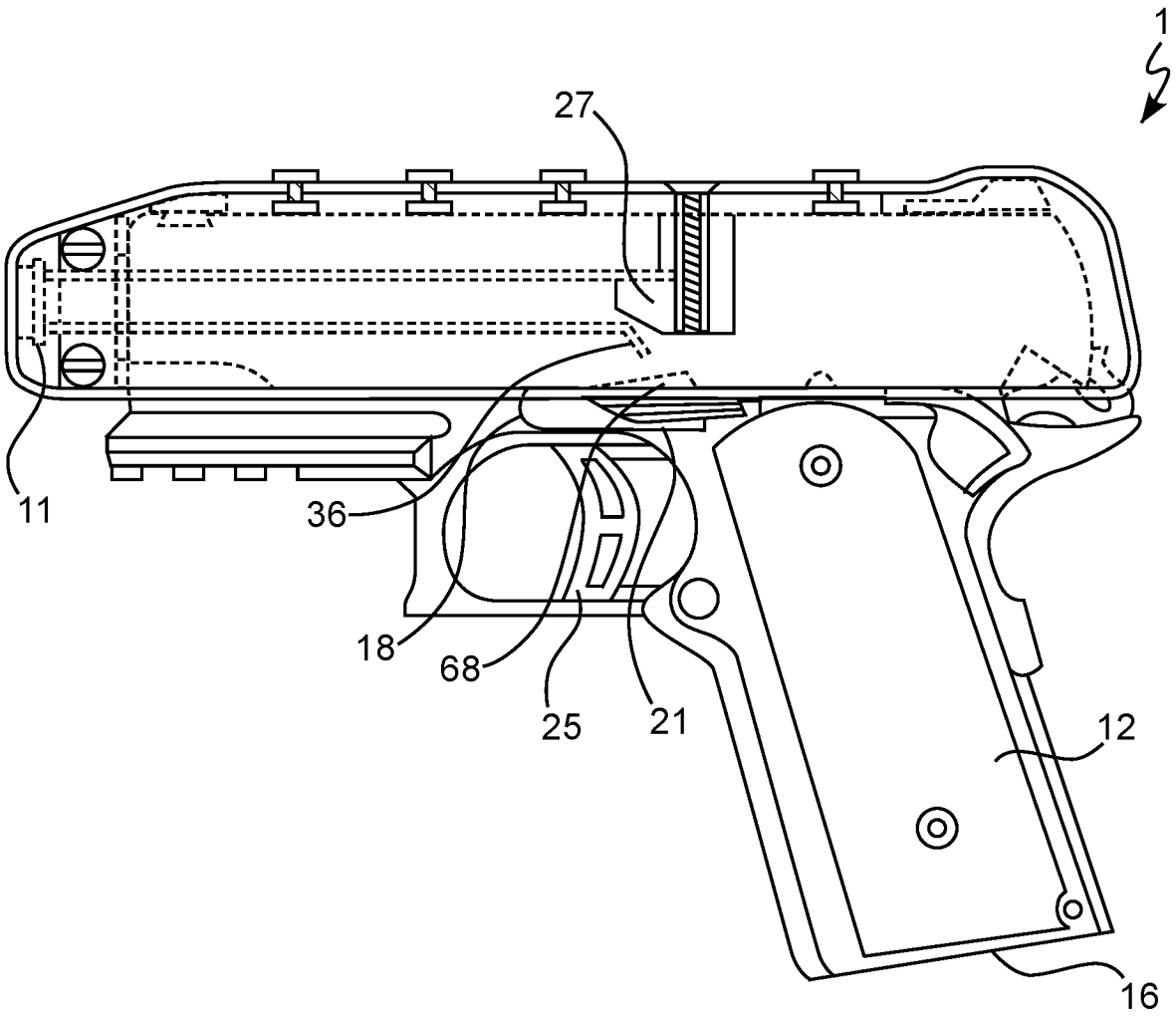
FIG. 10 is a side view of the holster shroud o FIG. 8A, with a firearm fully inserted in the shroud.

Referring now to FIG. 10, the shroud 1 is shown with the firearm fully inserted, after the protuberance 68 has engaged the thumb actuator 21 of the slide lock lever 18 to disengage the slide lock lever 18 from the slide 7. The firearm may then move to the partially retracted position shown in FIG. 10 via decompression of the recoil spring of the firearm. The locking lug 27 is seated in the chamber 14 of the firearm, blocking the feed ramp 36 (see FIG. 4) and preventing a round from entering the chamber 14. Additionally, the trigger 25 is disengaged in the partially retracted position of the firearm such the firearm cannot be discharged. Also shown in FIGS. 9-10 is that the magazine chamber 16 of the firearm is empty, or an unloaded magazine is inserted, so that the feed ramp 36 is not operational.

Referring now to FIGS. 11A-12C, the shroud 1 may be secured to a belt mount 69 for attachment to the belt 4 of the user. The belt mount 69 may include a substantially L-shaped bracket having a top 72 which mounts to the mounting spline 65 of the shroud 1. The top 72 may have holes which align with one or more of the receiving holes 67 in the top 52*a* of the shroud 1 and the corresponding threaded holes in the mounting spline 65. As such, the belt mount 69 may be secured to the mounting spline 65 by fasteners 73 inserted through the top 72 of the belt mount 69, the top 52*a* of the shroud 1, and the mounting spline 65. The fasteners 73 may have a hex head or other suitable configuration such that the fasteners can be assembled and disassembled by a wrench 76 carried on the belt mount 76. Configurations of the fasteners 73 and the corresponding wrench 76 other than a hex head configuration may be appreciated by those skilled in the art. The belt mount 69 may be adjustable relative to the shroud 1 by aligning the holes in the top 72 of the belt mount 69 with different receiving holes 67 of the top 52*a* of the shroud 1.

The top 72 of the belt mount 69 may form one leg of the L-shaped bracket of the belt mount 69, while the other leg of the L-shaped bracket may extend along one of the sides 52*b* of the shroud 1 and include a loop through which a belt 4 may be inserted. The belt mount 69 may be symmetrical such that the belt mount 69 can be flipped to either side 52*b* of the shroud 1 to accommodate both right-side and left-side carry of the firearm, as well cross-draw carry on either the right or left side of the user. The belt mount 69 may include a belt drag knob 77 which extends inwardly from the loop of the belt mount 69 against the belt 4 to prevent movement or slippage of the belt 4 relative to the belt mount 69.

Figure 11A:
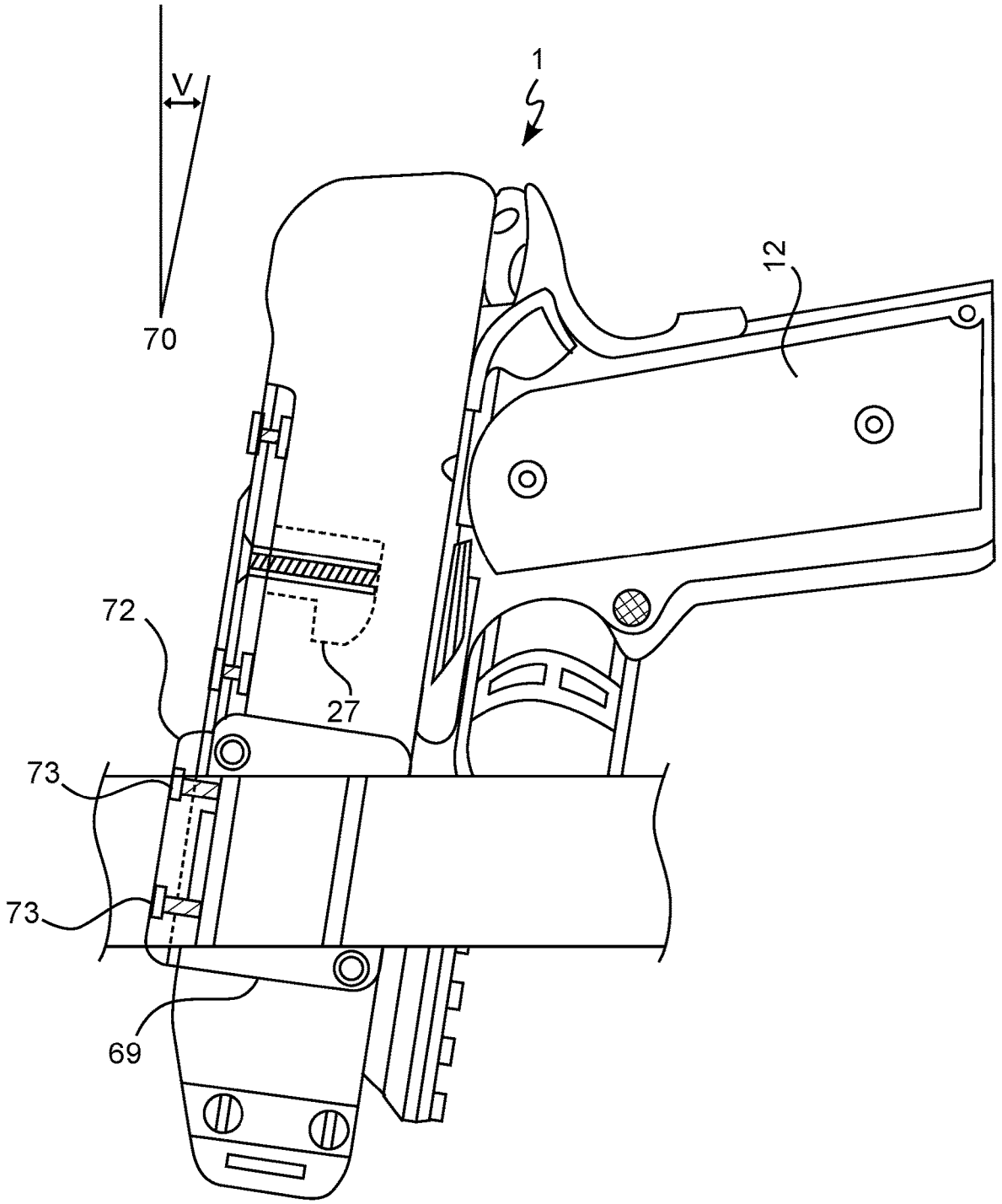
FIG. 11A is a side view of holster shroud of FIG. 8A equipped with a belt mount and canted rearward.
Figure 11B:
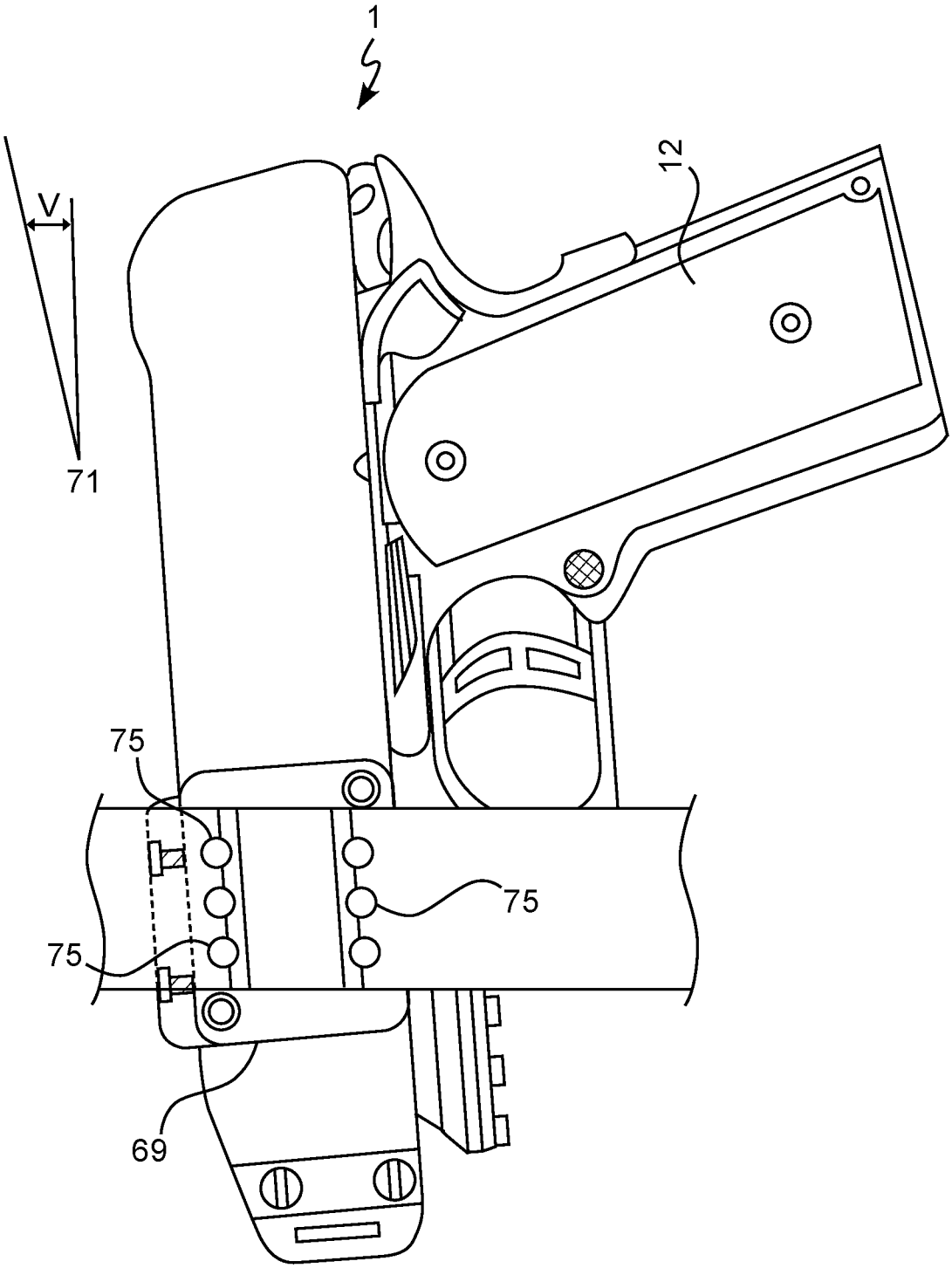
FIG. 11B is a side view of holster shroud of FIG. 8A equipped with a belt mount and canted forward.

With continued reference to FIGS. 11B, the belt mount 69 may include a plurality of side holes 75 to allow for canting and positioning of the shroud 1 relative to the belt 4 of the user. In FIG. 11A, the shroud 1 is arranged with a rearward cant 70 relative to a vertical direction V, achieved by inserting screws or other fasteners into top left and bottom right side holes 75 of the belt mount 69. In FIG. 11B, the shroud 1 is arranged with a forward cant 71 relative to the vertical direction V, achieved by inserting screws or other fasteners into top right and bottom left side holes 75 of the belt mount 69. The fasteners inserted into the side holes 75 abut the belt 4 to dictate the cant of the belt mount 69 and shroud 1 relative to the belt 4. While not shown in the drawings, it will be appreciated by those skilled in the art that the shroud 1 could be arranged in a straight (i.e. no cant) position by inserting screws into the bottom left and bottom right side holes 75, or by inserting screws into the top left and top right side holes 75. As shown in FIG. 11B, the plurality of side holes 75 may be arranged in parallel columns so that one screw may be inserted into a side hole 75 of each column. The particular side hole 75 into which the screws are inserted may be selected to accommodate the width of the belt 4 and the desired cant of the shroud 1. That is, the screws may be inserted into side holes 75 which are farther apart from one another for a wider belt 4, and the screws may be inserted into side holes 75 which are farther apart from one another for a narrower belt 4. The screws inserted into the side holes 75 may have heads compatible with the wrench 76 to allow adjustment to the cant of the shroud 1 via the wrench 76.

Figure 12A:
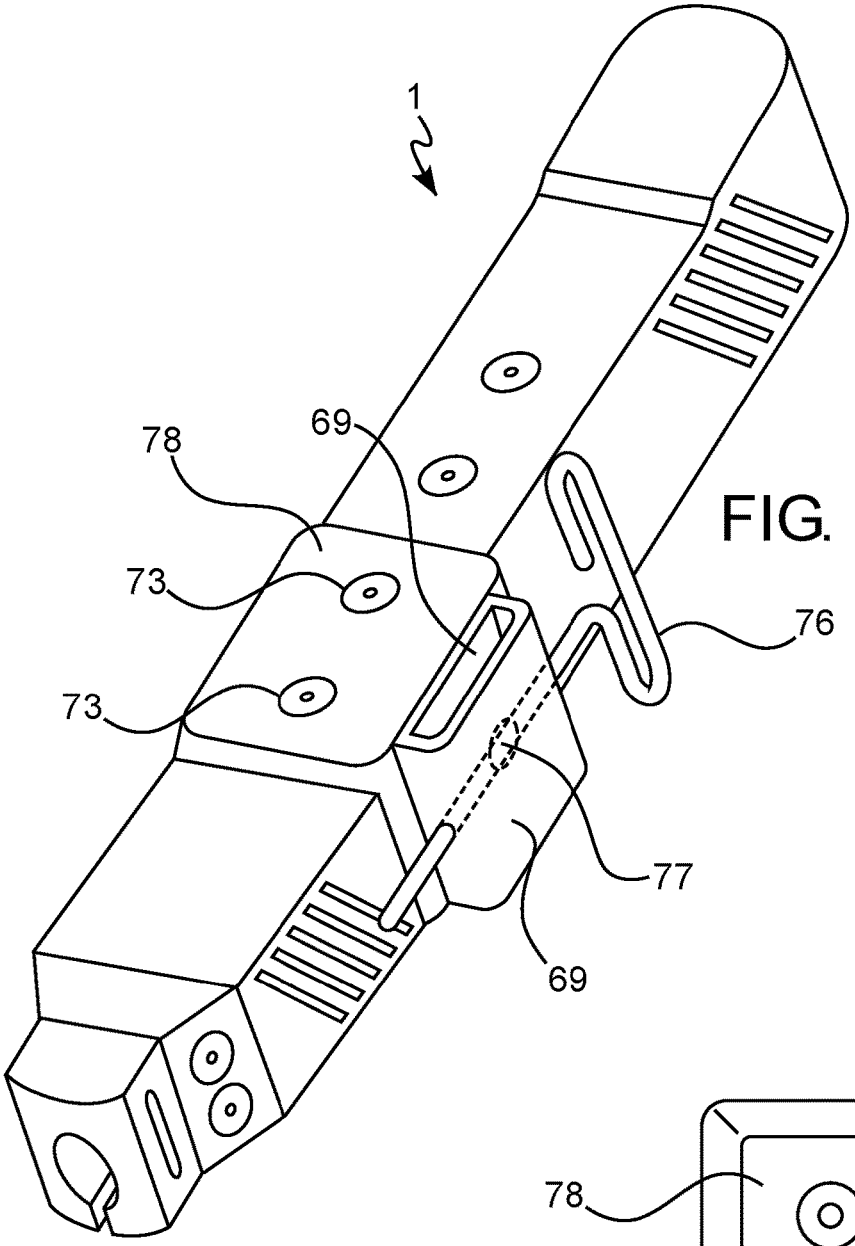
FIG. 12A is perspective view of the holster shroud with belt mount of FIGS. 11A-11B.
Figure 12B:
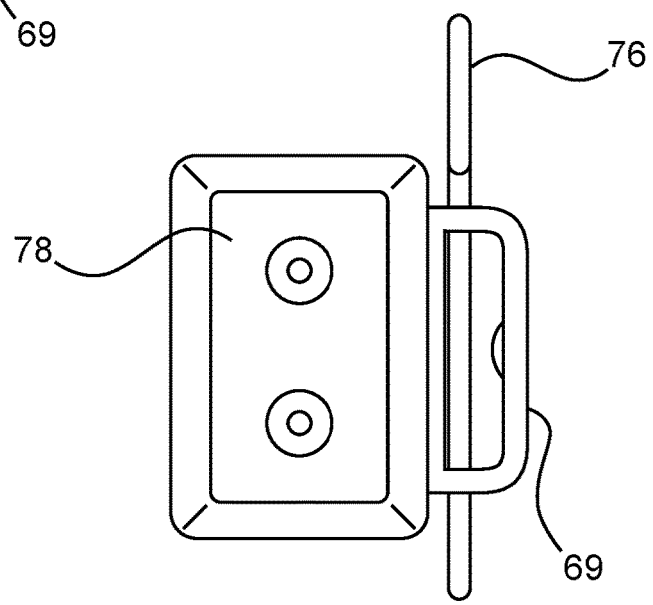
FIG. 12B is a top view of the belt mount of FIGS. 11A-11B.
Figure 12C:
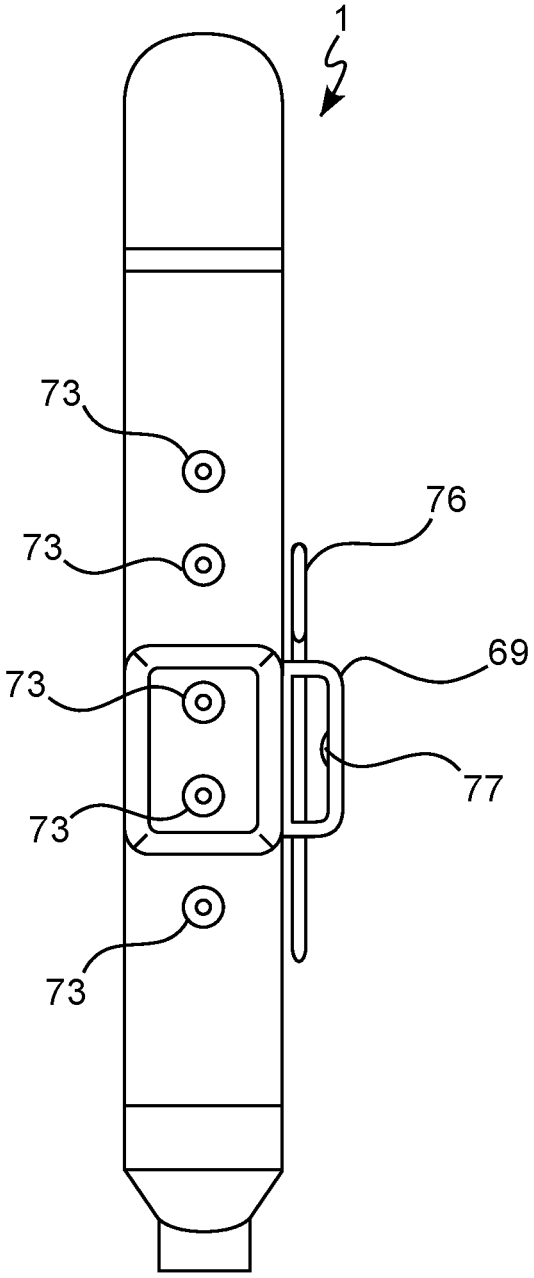
FIG. 12C is a top view of the holster shroud with belt mount of FIGS. 11A-11B.
Figure 12D:
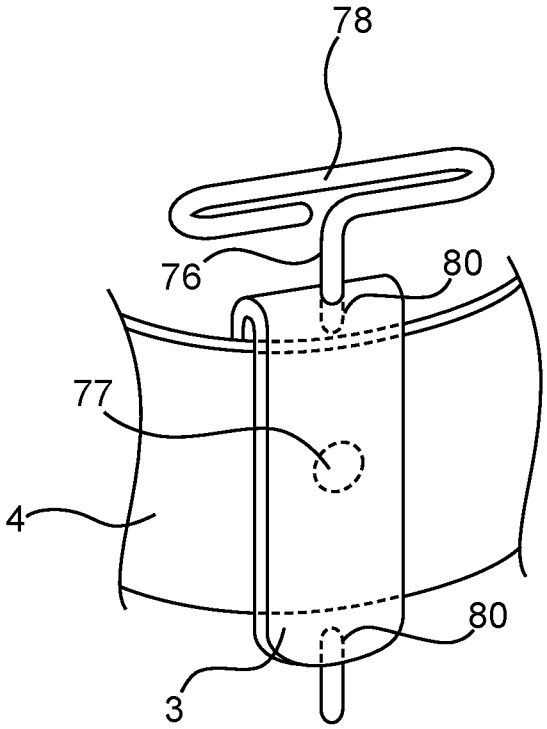
FIG. 12D is a perspective view of a belt retainer according to an embodiment of the of the present invention.
Figure 12E:
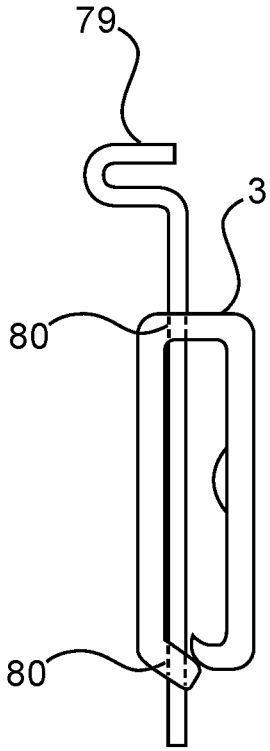
FIG. 12E is a side view of a belt retainer according to another embodiment of the present invention.
Figure 12F:
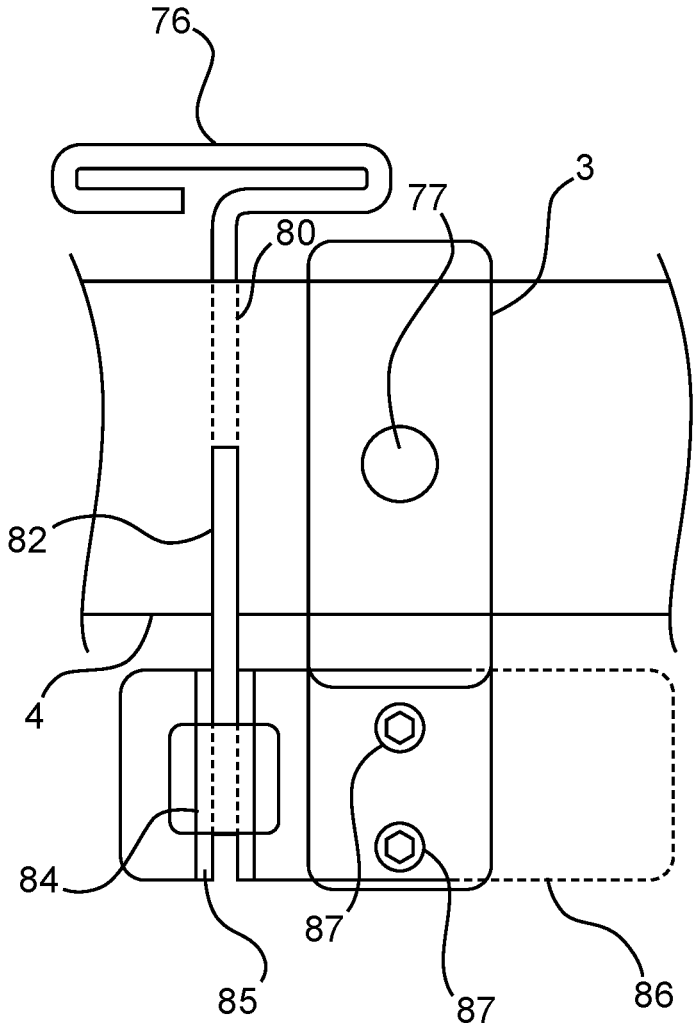
FIG. 12F is a side view of a belt retainer according to another embodiment of the present invention.

Referring now to FIGS. 12D-12F, some embodiments of the present invention are directed to an independent belt retainer 3 for holding the wrench 76 apart from the shroud 1. The belt retainer 3 includes a belt drag knob 77 which may be substantially identical to the belt drag knob 77 formed on the belt mount 69 described above with reference to FIGS. 12A-12C. In some embodiments, shown in FIGS. 12D-12E, the belt retainer 3 may include insertion holes 80 in the top and bottom adapted for receiving the wrench 76. The wrench 76 may thus extend through the belt retainer 3 on the side of the belt 4 opposite the belt drag knob 77. The handle 78, 79 of the wrench 76 may be curved to follow the profile of the user's body when the wrench 76 is carried in the belt retainer 3.

In some embodiments, shown in FIG. 12F, the belt retainer 3 may include a magnetic pad 86 to which the wrench 76 may be attached. The magnetic pad 86 may be secured to the top, bottom, or sides, of the belt retainer 3 via fasteners 87. The magnetic pad 86 may include a magnet 84 to which the wrench 76 is attracted. The bottom of the magnetic pad 86 may include a closed end funnel 85 to assist the magnet 84 in retaining the wrench 76 in place in the belt retainer 3. The magnetic pad 86 may be reversible such that it may be positioned on opposite sides of the belt retainer 3 as desired, as indicated by the dotted lines in FIG. 12F. In addition, the magnetic pad 86 may be oriented such that the wrench 76 is carried on either the inside or the outside of the belt 4. As shown in FIG. 12F, reference numeral 81 indicates the shaft of the wrench 76 with the magnetic pad 86 arranged for inside-the-belt carry, while reference numeral 82 indicates the shaft of the wrench 76 with the magnetic pad 86 arranged for outside-the-belt carry.

In addition to providing a means for adjusting and fastening the belt mount 69 to the shroud 1, the wrench 76 may be readily accessible from the belt 4 for use as a weapon in situations where use of the firearm is not rational or possible.

Figure 13A:
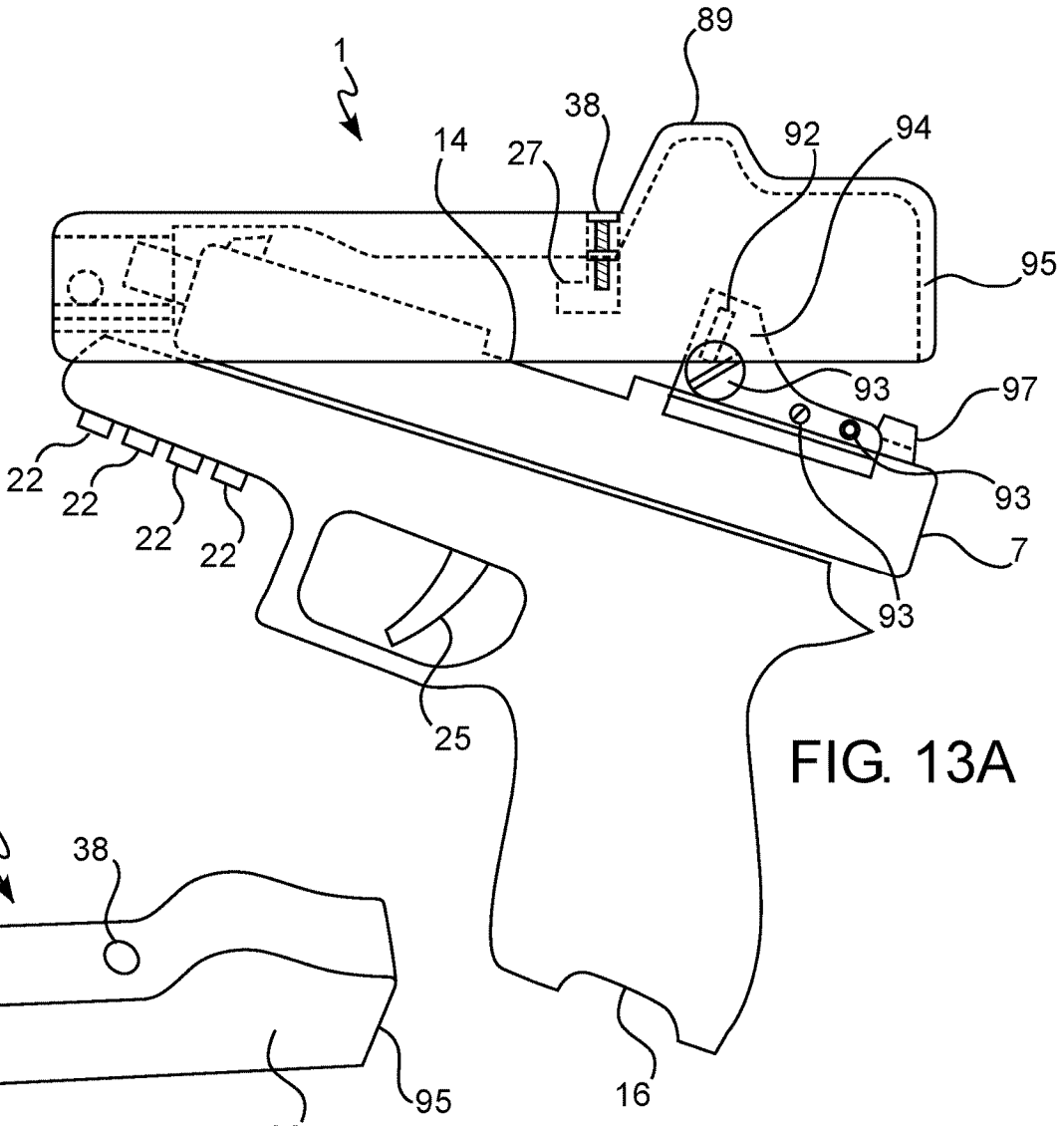
FIG. 13A is a side view of a holster shroud according to another embodiment of the present invention, with a firearm partially inserted in the shroud.

Referring now to FIGS. 13A-14C, some embodiments of the shroud 1 are configured for use with firearms equipped with a sight accessory such as a red dot sight 91. The embodiment of the shroud 1 shown in FIGS. 13A-13C is particularly configured for a red dot sight 91 having a width less than or equal to the width of the slide 7 of the firearm such that the internal width of the slide 7 need not be widened to accommodate the red dot sight 91. As shown in FIGS. 13A-13C, the red dot sight 91 generally has a housing 94 which has a width not more than the internal width of the slide 7. The housing 94 supports an optic 92 which projects a dot or symbol onto objects in a firing path of the firearm. The housing 94 may include one or more adjustment controls 93, such as screws, knobs, dials, and/or the like, which may be used to adjust and calibrate optic 92.

The optic 92 may be at least partially transparent so that, in the event of the optic 92 becoming blurred or a battery failure of the red dot sight 91, the conventional sights of the firearm may still be used to aim the firearm. The red dot sight 91 may include elevated rear sight 97 to account for the height added to the slide 7 by the red dot sight 91.

Figure 13B:
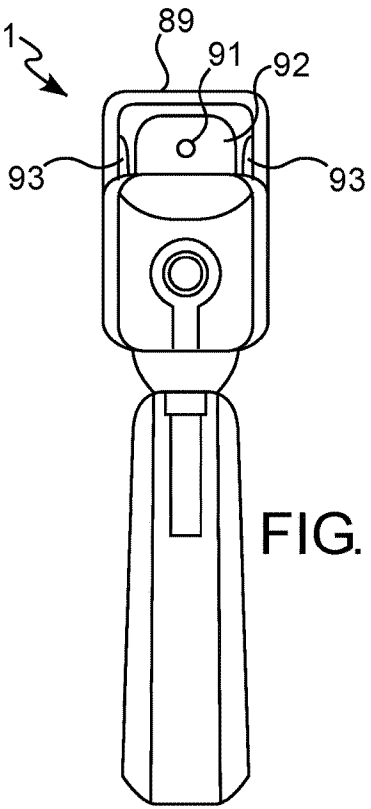
FIG. 13B is a rear view of the holster shroud of FIG. 13A, with a firearm fully inserted in the shroud.
Figure 13C:
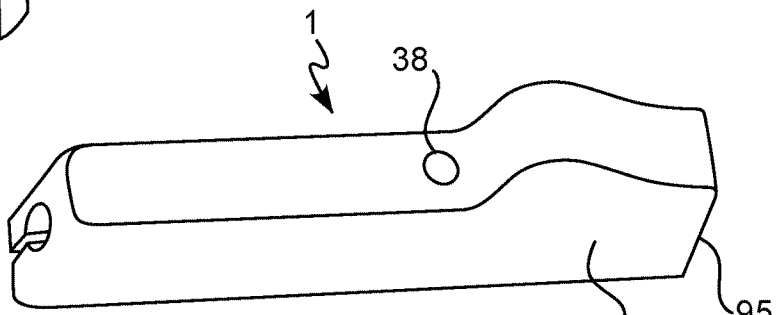
FIG. 13C is a perspective view of the holster shroud of FIG. 13A.

The shroud 1 of FIGS. 13A-13C is substantially the same as that described above with reference to FIGS. 1-12C, including the locking lug 27 which occupies the open chamber 14 of the slide 7 when the firearm is fully inserted in the shroud 1. The differences between the shroud 1 of FIGS. 1-12C and the shroud 1 of FIGS. 13A-13C will be discussed below. The shroud 1 may include an elevated section or cavity 89 and rear portion 95 configured to receive the red dot sight 91 when the firearm is holstered in the shroud 1. Thus, the optic 92 is protected while the firearm is holstered. Because the width of the red dot sight 91 is less than or equal to the width of the slide 7, the side surfaces 96 of the shroud 1 may be uninterrupted along the length and height of the slide 7. That is, the side surfaces 96, extending along the length of the slide 7, need not extend outwards in the vicinity of the red dot sight 91.

Figure 14A:
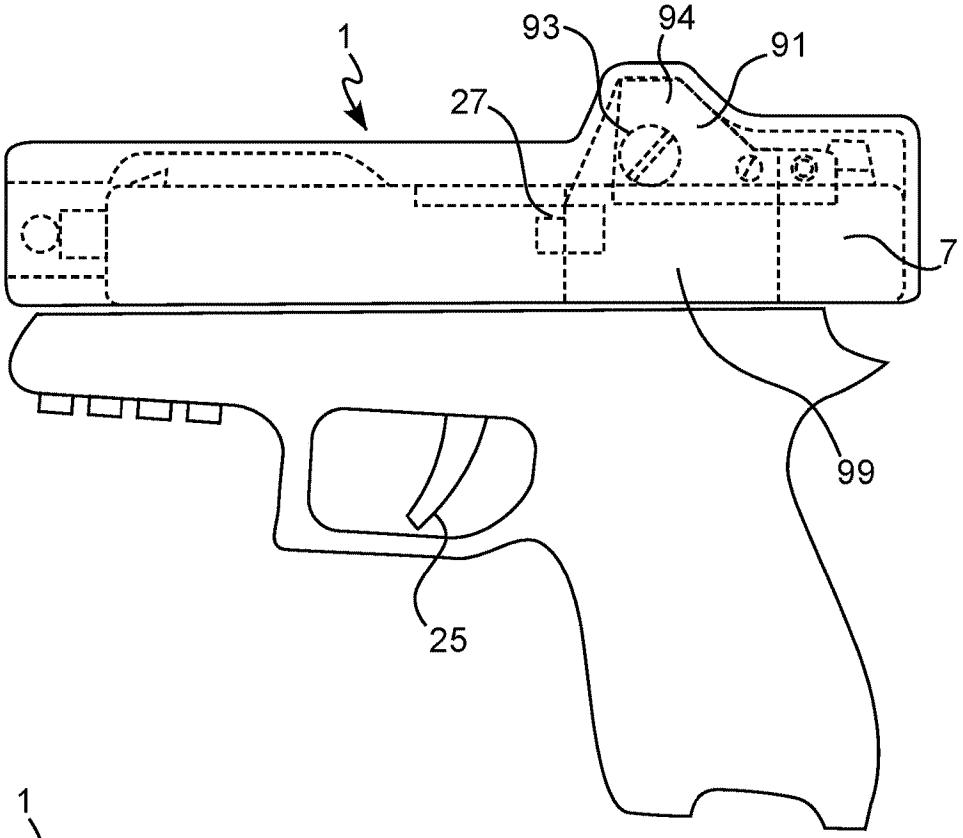
FIG. 14A is a side view of a holster shroud according to another embodiment of the present invention, with a firearm fully inserted in the shroud.
Figure 14C:
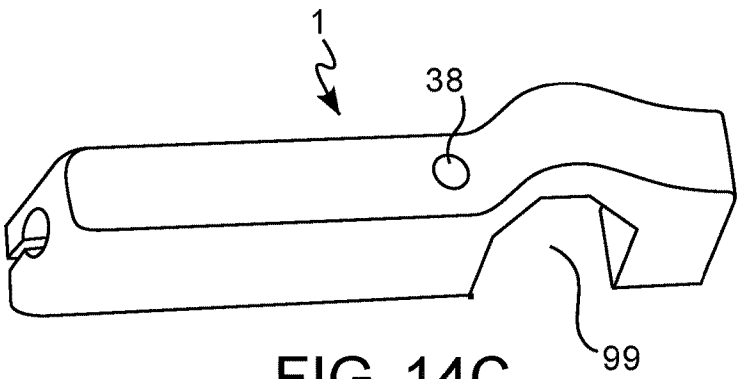
FIG. 14C is a perspective view of the holster shroud of FIG. 14A.
Figure 14B:
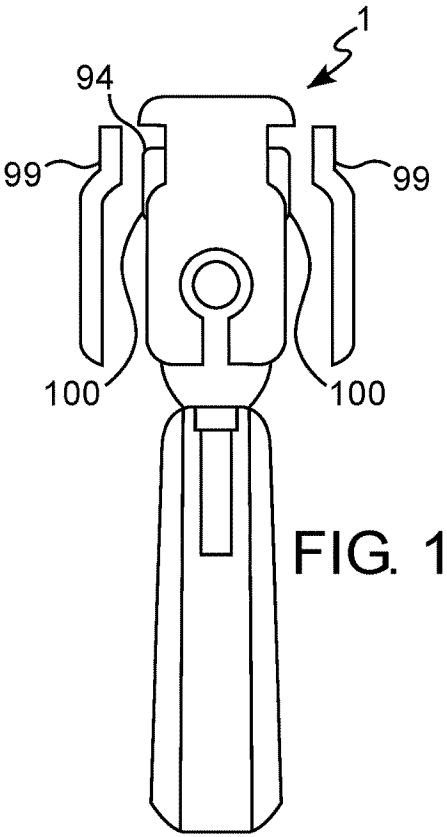
FIG. 14B is a rear view of the holster shroud of FIG. 14A, with a firearm fully inserted in the shroud.

The shroud 1 shown in FIGS. 14A-14C is particularly configured for a red dot sight 91 having at least one protruding portion 100 which extends wider than the width of the slide 7. The at least one protruding portion 100 may be the adjustment controls 93, the housing 94, or any other component of the red dot sight 91. To accommodate holstering and unholstering of the firearm without interfering with at least one protruding portion 100, the shroud 1 defines one or more cut-out sections or raised panels 99 corresponding to the locations of the at least one protruding portion 100. Other than the cut-out sections or raised panels 99, the shroud 1 of FIGS. 14A-14C is substantially the same as the shroud of FIGS. 13A-13C.

The methods for holstering and unholstering a firearm into and out of the shrouds 1 of FIGS. 13A-13C and FIGS. 14A-14C is substantially identical to the method described above for any of the embodiments of FIGS. 1-12C.

The materials used for the various components of the embodiments of a holster assembly, as described herein, may be any suitable durable material, such as metals, plastics, fiber re-enforced plastics, high density polymer, or other polymer materials. In some embodiments, the components of the holster assemblies may be made of a material that is extremely durable and impervious to heat, cold, and solvents, e.g., high-strength aluminum, ZYTEL®, DELRIN®, or other similar high-strength plastic composites. As is appreciated by those skilled in the art, the invention is not limited to such materials used to make the holster assemblies according to embodiments of the present invention.

While the present invention has previously been described with respect to the non-limiting embodiments described herein, it is envisioned that other modifications and additions to the invention hereinbefore described may be made by those skilled in the art without deviating from the spirit of the invention. Accordingly, it is intended that such modifications and additions be included within the scope of the present invention, insofar as set forth in the following claims and equivalents thereof.

The invention claimed is:

1. A holster, comprising:

a hip plate; and a shroud mounted to the hip plate, the shroud comprising:

a channel adapted to receive a slide of a firearm;

a slide block extending into an open portion of the channel and configured to abut a muzzle end of the slide received in the channel to prevent forward movement of the slide; and a locking lug extending into the open portion of the channel and configured to engage a chamber of the slide to prevent movement of the slide, wherein the shroud is configured to contact a lock lever of the firearm during insertion of the firearm into the shroud such that the lock lever disengages from the slide, thereby allowing the slide to move from a fully retracted position to a partially retracted position.

2. The holster of claim 1, wherein the locking lug extends into the chamber such that a round in a magazine of the firearm received in the shroud is prevented from entering the chamber.

3. The holster of claim 1, wherein the locking lug extends into the channel of the shroud such that, if the firearm has a round chambered, the locking lug contacts the round and prevents the firearm from being seated in the shroud.

4. The holster of claim 1, wherein the shroud is removably mounted to the hip plate.

5. The holster of claim 1, further comprising a locking bar inserted into a locking pin aperture of the shroud, the locking bar abutting a muzzle of the firearm to prevent forward movement of the muzzle within the shroud.

6. The holster of claim 4, wherein the locking bar is rectilinear and configured to engage a front face of the muzzle.

7. The holster of claim 5, wherein the locking bar comprises a locking device configured to prevent removal of the locking bar from the locking pin aperture.

8. The holster of claim 7, wherein the locking device is pivotally connected to the locking bar via a bearing.

9. The holster of claim 1, wherein the shroud further comprises at least one cavity for receiving a sight accessory affixed to the slide of the firearm.

10. The holster of claim 9, wherein the sight accessory comprises an optic.

11. The holster of claim 1, wherein the shroud defines at least one cut-out section to avoid interference with a sight accessory affixed to the slide of the firearm.

12. The holster of claim 1, wherein the shroud further comprises at least one raised panel to avoid interference with a sight accessory affixed to the slide of the firearm.

13. A method for holstering a firearm, comprising:

pulling a slide of the firearm to a fully retracted position relative to a grip of the firearm;

engaging a lock lever of the firearm with a detent of the slide to retain the slide in the fully retracted position;

inserting a muzzle end of the slide into a shroud of a holster until the muzzle end of the slide contacts a slide block of the shroud; and rotating the grip of the firearm such that the slide aligns with the shroud of the holster, wherein the shroud is configured to contact the lock lever of the firearm during insertion of the slide into the shroud such that the lock lever disengages from the detent of the slide, thereby allowing the slide to move from a fully retracted position to a partially retracted position.

14. The method of claim 13, further comprising:

inserting a locking bar into a locking pin aperture of the shroud to prevent forward motion of the grip relative to the slide block.

15. The method of claim 13, further comprising:

prior to pulling the slide of the firearm to the fully retracted position, at least partially ejecting a magazine from the grip; and after rotating the grip of the firearm such that the slide aligns with the shroud of the holster, re-seating the magazine in the grip.

16. A holster, comprising:

a belt mount; and a shroud mounted to the belt mount, the shroud comprising:

a channel adapted to receive a slide of a firearm;

a slide block extending into an open portion of the channel and configured to abut a muzzle end of the slide received in the channel to prevent forward movement of the slide; and a locking lug extending into the open portion of the channel and configured to engage a chamber of the slide to prevent movement of the slide, wherein the shroud further comprises a protuberance configured to contact a lock lever of the firearm during insertion of the firearm into the shroud such that the lock lever disengages from the slide, thereby allowing the slide to move from a fully retracted position to a partially retracted position.

17. The holster of claim 16, wherein the belt mount comprises an L-shaped bracket adjustably mounted to the shroud and configured to receive a belt through a portion of the belt mount.

18. The holster of claim 16, wherein the belt mount comprises a belt drag knob adapted to press against the belt received through the belt mount, thereby retaining the belt in the belt mount.

19. The holster of claim 16, further comprising:

a wrench configured to be carried in the belt mount, wherein the wrench is configured to secure and remove fasteners connecting the belt mount to the shroud.

20. The holster of claim 16, wherein the belt mount comprises one or more side holes configured to receive fasteners for adjusting a cant of the shroud relative to a belt of a user.

21. The holster of claim 16, wherein the shroud is made by folding a substantially flat piece of material to define the channel adapted to receive the slide of the firearm.

* * * * *